US008099005B2

(12) United States Patent
Akatsu

(10) Patent No.: US 8,099,005 B2
(45) Date of Patent: Jan. 17, 2012

(54) IMAGE FORMING APPARATUS

(75) Inventor: Shinichi Akatsu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 377 days.

(21) Appl. No.: 12/512,444

(22) Filed: Jul. 30, 2009

(65) Prior Publication Data

US 2010/0040389 A1 Feb. 18, 2010

(30) Foreign Application Priority Data

Aug. 12, 2008 (JP) ..... 2008-208175

(51) Int. Cl.
*G03G 15/00* (2006.01)

(52) U.S. Cl. ..... 399/48

(58) Field of Classification Search ..... 399/48, 399/46, 49, 50, 51
See application file for complete search history.

(56) References Cited

U.S. PATENT DOCUMENTS 5,404,203 A * 4/1995 Kinoshita et al. ..... 399/46
6,131,000 A 10/2000 Akatsu et al.
6,271,874 B1 8/2001 Maruo et al.
6,556,229 B2 4/2003 Mitsuya et al.
6,684,036 B2 1/2004 Kubota et al.
6,738,586 B2 5/2004 Kubota et al.
7,245,841 B2 7/2007 Akatsu et al.
2007/0212086 A1 9/2007 Yagawara et al.
2008/0019718 A1 1/2008 Akatsu et al.
2008/0317486 A1 12/2008 Monma et al.

FOREIGN PATENT DOCUMENTS

JP 3-253873 11/1991
JP 5-14729 1/1993
JP 7-253694 10/1995
JP 2000-330345 11/2000
JP 2005242146 A * 9/2005

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

A printer determines, in a process control, a reference exposure amount. A charging unit charges a surface of a photosensitive element to a target potential. After an exposure target area on the charged surface of the photosensitive element is exposed to a high adjustment exposure that corresponds to a high-exposure amount area, a control unit determines the reference exposure amount based on the target potential and a detected residual potential that is a result detected by a potential detecting unit as a potential of the target exposure area on the photosensitive element after being exposed to the high adjustment exposure.

7 Claims, 15 Drawing Sheets

IMAGE FORMING APPARATUS

CROSS-REFERENCE TO RELATED APPLICATIONS

The present application claims priority to and incorporates by reference the entire contents of Japanese Patent Application No. 2008-208175 filed in Japan on Aug. 12, 2008.

BACKGROUND OF THE INVENTION

1. Field of the Invention

The present invention relates to image forming apparatuses and, more particularly, to an image forming apparatus that adjusts an amount of reference exposure so that an exposure unit performs image formation properly.

2. Description of the Related Art

Image forming apparatus that performs a process control is widely known. In the process control, an image forming apparatus disclosed in Japanese Patent Application Laid-open No. H5-14729 forms a toner pattern on a photosensitive element under predetermined conditions in the same manner as a normal toner image is formed. It then uses a sensor to detect the amount of toner forming the toner pattern and adjusts various parameters based on the result of the detection, such as charging bias, developing bias, and the amount of reference exposure (hereinafter, "reference exposure amount"). These actions are performed so that a desirable image can be formed. In such an image forming apparatus, the relations are determined between development potential and various parameters, such as the charging bias, the developing bias, and the reference exposure amount, (hereinafter, "the various parameters"). These relations are determined using the results of experiments or the like. A data table including the development potential and the corresponding various parameters is stored in a storage device in the image forming apparatus. In the process control, the image forming apparatus acquires the result detected by the sensor, calculates the development potential based on the result, identifies the various parameters corresponding to the calculated development potential by referring to the data table, and sets identified various parameters. In some image forming apparatuses, the development potential is determined using another parameter, such as a development gamma instead of the various parameters mentioned above.

Once the development potential is calculated based on the result detected by the sensor, the image forming apparatus can adjust the various parameters to suitable values by referring only to the data table. The simplicity with which adjustments can be made is an advantage of the image forming apparatuses using the data table.

The simple adjustment system using the data table can work properly only when the relations between the development potential and the various parameters are not significantly affected by the passage of time and changes in the environment. If the relations between the development potential and the various parameters are affected significantly by the passage of time or changes in the environment, it is necessary to store additional data tables for expected changes due to the passage of time and changes in the environment. This increases the amount of data required, which means that the simple adjustment system using the data tables becomes less attractive.

Photosensitive elements are widely known that have a high wear resistance and a long operating life. The photosensitive elements have a surface layer containing a filler that gives the elements their high wear resistance.

According to studies by the inventors, it has been confirmed that, if a longer-lasting photosensitive element is used, the relation between the amount of exposure (hereinafter, "exposure amount") that is used for image formation and the potential of an exposed area (hereinafter, "exposed-area potential VL") changes significantly with the passage of time and because of changes in the environment.

The exposure amount, hereinafter, is calculated by multiplying the power of a light source (hereinafter, "exposure power") per unit area on the surface of the photosensitive element (e.g., area corresponding to a 1-dot electrostatic latent image) by an exposure time (hereinafter, "unit exposure time").

FIG. 14A is a graph for explaining the relation between the exposure power of a laser diode (LD) and the exposed-area potential VL that is observed after image formation is performed at predetermined times in a high-temperature and high-humidity environment. FIG. 14B is a graph for explaining the relation between the exposure power of the LD and the exposed-area potential VL that is observed when image formation is performed at the predetermined times the same as in the example illustrated in FIG. 14A in low-temperature and low-humidity environment. The unit exposure time is set to the longest values available for image formation. It is clear from the graphs that the relation between the exposure power that is used for image formation (ranging from the left side to around the center of each of the graphs in FIGS. 14A and 14B) and the exposed-area potential VL changes significantly depending on the differences in the environments. Therefore, if a photosensitive element is used in which the relation between the exposure amount that is used for image formation and the exposed-area potential VL can change significantly (hereinafter, "specific photosensitive element"), the relation between the exposure power that is used for image formation and the exposed-area potential VL significantly changes due to the changes in the environment.

The difference in the relation between the exposure amount that is used for image formation and the exposed-area potential VL can be expressed by the difference in the potential of the exposed area that is detected when the surface of the photosensitive element is exposed by the LD at the maximum exposure amount. In other words, the difference in the relation between the exposure amount and the exposed-area potential VL can be calculated using the difference in residual potential that remains on the surface of the photosensitive element after the exposure unit irradiates the photosensitive element with light to discharge electricity, with the irradiated light being at the maximum exposure amount (hereinafter, "residual exposed-area potential Vr"). The exposed-area potential VL corresponding to the maximum exposure power, i.e., the exposed-area potential VL furthest to the right in each of FIGS. 14A and 14B, corresponds to the residual exposed-area potential Vr. It is clear from FIGS. 14A and 14B that the residual exposed-area potential Vr in the high-temperature high-humidity environment is low, while the residual exposed-area potential Vr in the low-temperature low-humidity environment is high. That is, the residual exposed-area potential Vr is affected significantly by the environment. The difference in the residual exposed-area potential Vr correlates to the difference in the relation between the exposure power that is used for image formation and the exposed-area potential VL.

FIG. 15 is a graph for explaining the relation between the number of sheets and the residual exposed-area potential Vr in an image forming apparatus that includes a specific photosensitive element.

It is clear from the graph that the residual exposed-area potential Vr changes significantly with the passage of time. Therefore, if a specific photosensitive element is used, the relation between the exposure power that is used for image formation and the exposed-area potential VL changes significantly with the passage of time.

In the image forming apparatus that includes a specific photosensitive element in which the relation between the exposure power that is used for image formation and the exposed-area potential VL can change significantly, the relations between parameters including the development potential and the reference exposure amount also change significantly. This is because the suitable exposed-area potential VL is determined by the development potential that is calculated based on the result detected by the sensor in the process control; nevertheless, the exposure power corresponding to the suitable exposed-area potential VL changes significantly with the passage of time or due to changes in the environment. Therefore, if the reference exposure amount suitable for acquiring the target exposure power is determined by referring to the data table in the same manner as in conventional image forming apparatus, disadvantages, such as an increase in the amount of required data, will outweigh the advantages.

SUMMARY OF THE INVENTION

It is an object of the present invention to at least partially solve the problems in the conventional technology.

According to an aspect of the present invention, there is provided an image forming apparatus that forms an image on a recording medium. The image forming apparatus includes a photosensitive element having a photoconductive property in which a ratio of a decrease in an exposed-area potential to an increase in an exposure amount decreases as the exposure amount increases; a charging unit that charges a surface of the photosensitive element evenly to a target potential; an exposure unit that exposes an exposure target area on charged surface of the photosensitive element to light of an exposure amount thereby forming an electrostatic latent image in the exposure target area by lowering a potential of the exposure target area, the exposure amount being determined based on a reference exposure amount that corresponds to a high-exposure amount area for which a ratio of a decrease in a potential of an exposure area on the photosensitive element to an increase in an exposure amount is smaller than a threshold; a developing unit that develops the electrostatic latent image on the photosensitive element into a toner image by applying toner to the electrostatic latent image using a developer carrier that is charged with a development bias; a transferring unit that transfers the toner image from the photosensitive element onto a recording medium; a control unit that determines the reference exposure amount that is used when the exposure unit performs image formation; and a potential detecting unit that detects a potential of the surface of the photosensitive element. When performing adjustment of exposure amount, the control unit causes the charging unit to charge the surface of the photosensitive element and, after the exposure target area on the charged surface of the photosensitive element is exposed to a high adjustment exposure that corresponds to the high-exposure amount area, determines the reference exposure amount based on either a detected charging potential that is detected by the potential detecting unit as a potential of the charged surface, or the target potential and a detected residual potential that is detected by the potential detecting unit as a potential of the target exposure area on the photosensitive element after being exposed to the high adjustment exposure.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 14A:
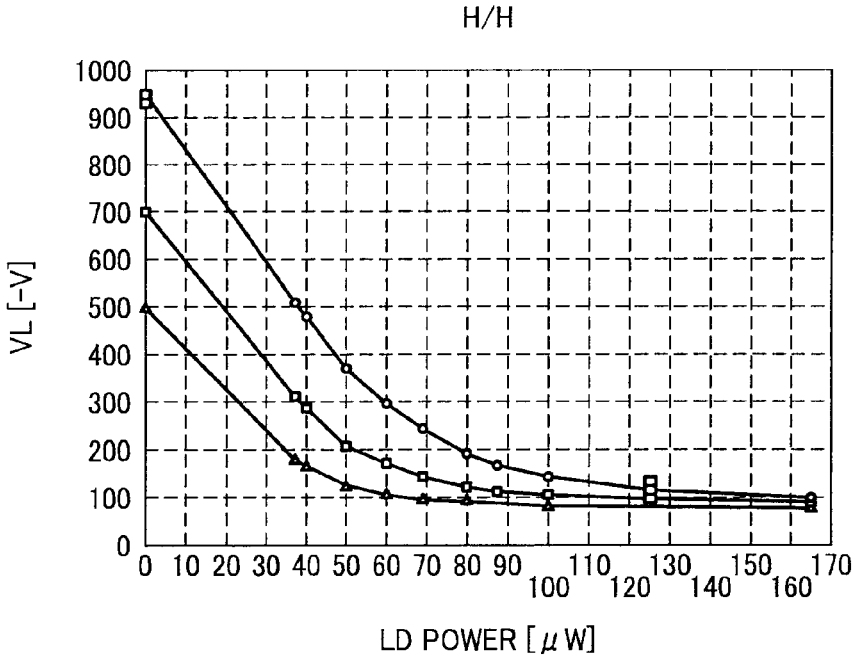
FIG. 14A is a graph for explaining a relation between exposure power of a laser diode (LD) and exposed-area potential that is observed after image formation is performed at predetermined times in the high-temperature and high-humidity environment.
Figure 14B:
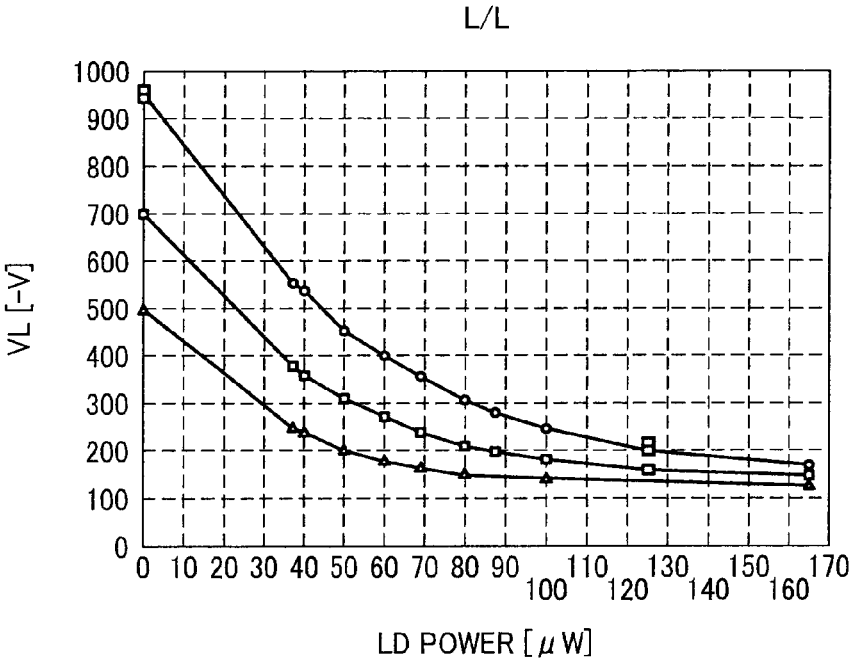
FIG. 14B is a graph for explaining a relation between the exposure power of the LD and the exposed-area potential that is observed when image formation is performed at the predetermined times the same as in the example illustrated in FIG. 14A in low-temperature and low-humidity environment.

In not only a specific photosensitive element but also a typical non-specific photosensitive element, as illustrated in FIGS. 14A and 14B, the ratio of the decrease in the exposed-area potential to the increase in the exposure amount decreases as the exposure amount increases. If the exposure amount decreases/increases within a high range in which the ratio corresponding to the exposure amount is smaller than a threshold, the exposed-area potential VL increases/decreases slightly. Therefore, with tone control, the exposure amount within the high range is set to a maximum value, and various tones are represented by decreasing the exposure amount step-by-step from a maximum value within a low range where the ratio is larger than the threshold. Even when the tone control is not needed, an exposure amount within the high range is used as a reference exposure amount to efficiently obtain the development potential.

The inventors found that even when the residual exposed-area potential changes with the passage of time or because of changes in the environment, as illustrated in FIGS. 16A to 16L, the shape of the graph indicative of the relation between the exposure amount and the exposed-area potential does not significantly change with the passage of time or because of changes in the environment. In other words, it is possible to anticipate the shape of the graph indicative of the current relation between the exposure amount and the exposed-area potential from the start point of the line of the graph, i.e., the potential of the surface of the photosensitive element when a charging unit charges the surface (hereinafter, "charging potential") and the end point of the line of the graph, i.e., the residual exposed-area potential. The charging potential is the potential furthest to the left in each of the graphs illustrated in FIGS. 16A to 16L. The residual exposed-area potential is furthest to the right in each of the graphs illustrated in FIGS. 16A to 16L.

The exposure amount is adjusted in the following manner according to an embodiment of the present embodiment. After the surface of the photosensitive element is charged to a predetermined target potential by the charging unit, the surface is exposed to an amount of high exposure for adjustment (hereinafter, "adjustment exposure amount"). The adjustment exposure amount is within a high range. The residual exposed-area potential is then detected by a potential detecting unit. Thus, the current residual exposed-area potential is acquired. After that, the charging potential representing the starting point is calculated from the target potential or the current charging potential that is actually detected by the potential detecting unit. The residual potential is actually detected by the potential detecting unit. The relation between the exposure amount and the exposed-area potential under the present conditions is then determined using the detected charging potential or the target potential and the detected residual potential. In this manner, an exposed-area potential is determined that is suitable for when the surface is exposed in the same manner as in the conventional manner to the light of the current reference exposure amount. After that, the reference exposure amount suitable for the present conditions is appropriately determined by referring to the relation between the exposure amount and the exposed-area potential.

Exemplary embodiments of the present invention are described in detail below with reference to the accompanying drawings. An electrophotographic printer is used as an image forming apparatus to explain the following embodiments.

Figure 1:
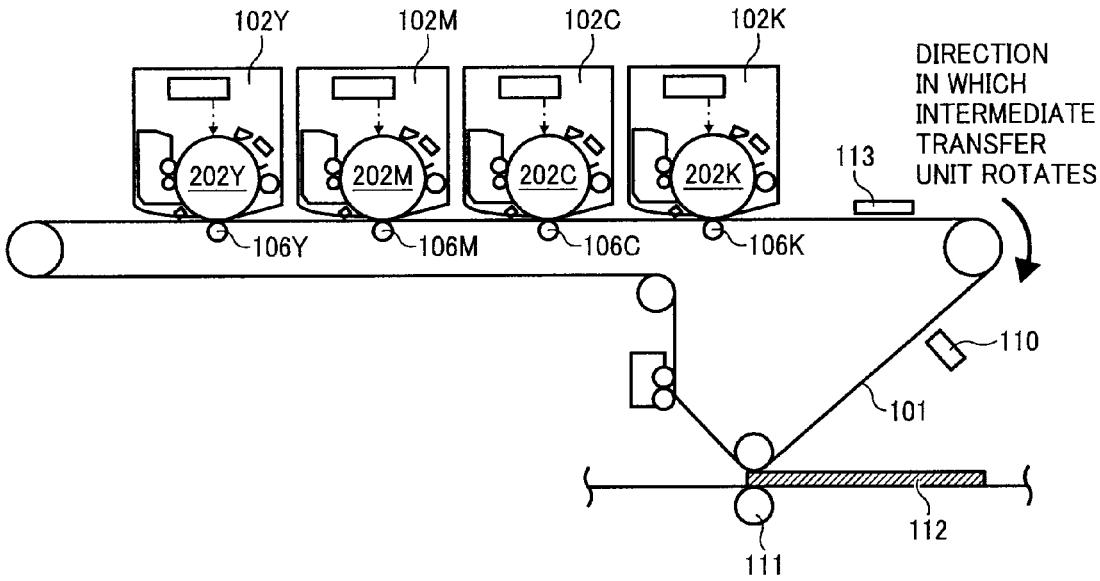
FIG. 1 is a schematic diagram of related parts of a printer according to an embodiment of the present invention.

FIG. 1 is a schematic diagram of related parts of a printer according to an embodiment of the present invention.

The printer includes image forming units 102Y (for yellow), 102M (for magenta), 102C (for cyan), 102K (for black) arranged along an intermediate transfer belt 101. The intermediate transfer belt 101 is supported by a plurality of supporting rollers. Toner images that are formed by the image forming units 102Y, 102M, 102C, 102K are transferred onto the intermediate transfer belt 101 by primary transfer devices 106Y, 106M, 106C, 106K, respectively. An image detecting device 110 is arranged opposed to a surface of the intermediate transfer belt 101. The image detecting device 110 detects an amount of toner attached to a toner image that is present on the intermediate transfer belt 101 (hereinafter, "attached toner amount"). The image detecting device 110 corresponds to an attached toner-amount detecting unit. The toner images are transferred from the intermediate transfer belt 101 to a recording sheet 112 as a recording medium by a secondary transfer device 111.

Figure 2:
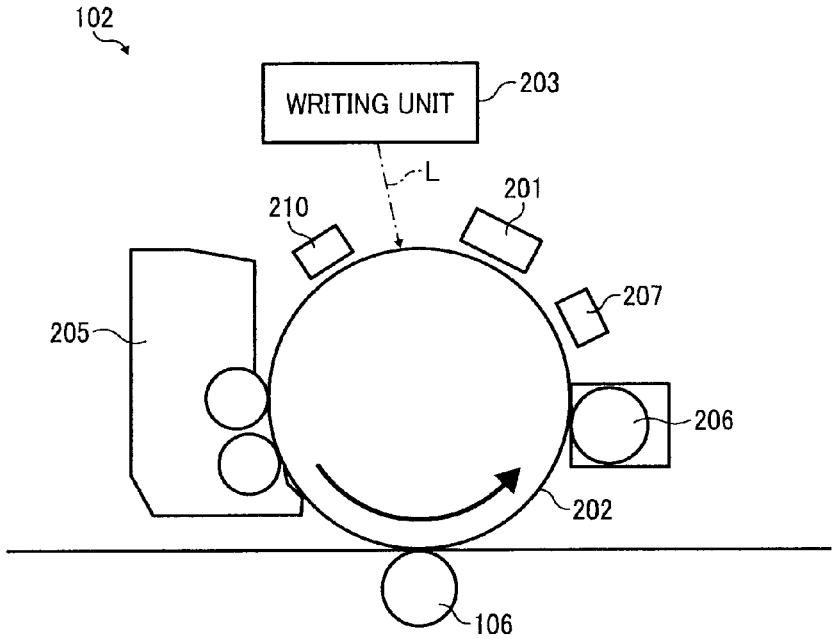
FIG. 2 is a schematic diagram of an image forming unit in the printer illustrated in FIG. 1.

FIG. 2 is a schematic diagram of an image forming unit 102 that can be any of the image forming unit 102Y, 102M, 102C, 102K. Because the image forming units 102Y, 102M, 102C, 102K have the same configuration, an arbitrary one of the image forming units 102Y, 102M, 102C, 102K will be referred to as "image forming unit 102"; therefore, the same description is not repeated.

The image forming unit 102 includes a photosensitive element 202 that can be any of photosensitive elements 202Y, 202M, 202C, 202K illustrated in FIG. 1. The image forming unit 102 includes a charging unit 201 that charges a surface of the photosensitive element 202; a writing unit 203 that writes an electrostatic latent image onto the surface of the photosensitive element 202 with a writing light L; a developing unit 205 that develops the electrostatic latent image with toner into a toner image; a photosensitive-element cleaner 206 that removes residual toner from the surface of the photosensitive element 202 after the transfer; a neutralizer 207 that neutralizes electrical charge on the surface of the photosensitive element 202; and a potential sensor 210 that measures a potential. These units are arranged around the photosensitive element 202. The writing unit 203 corresponds to an exposure unit. The photosensitive-element cleaner 206 corresponds to a cleaning unit. The neutralizer 207 corresponds to a neutralizing unit.

Figure 15:
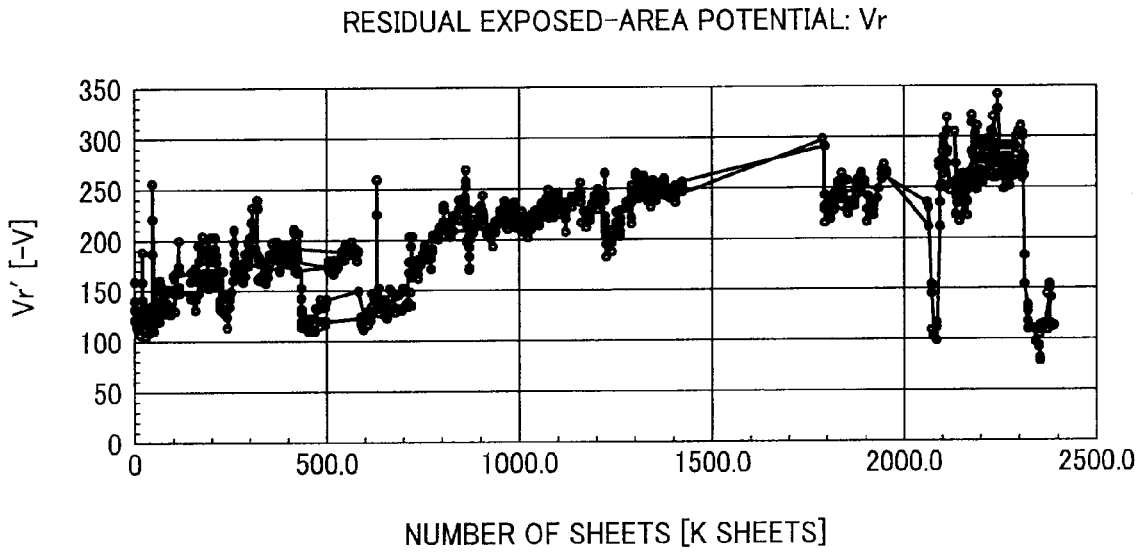
FIG. 15 is a graph for explaining a relation between number of sheets and a residual exposed-area potential in an image forming apparatus that includes a specific photosensitive element.
Figure 16A:
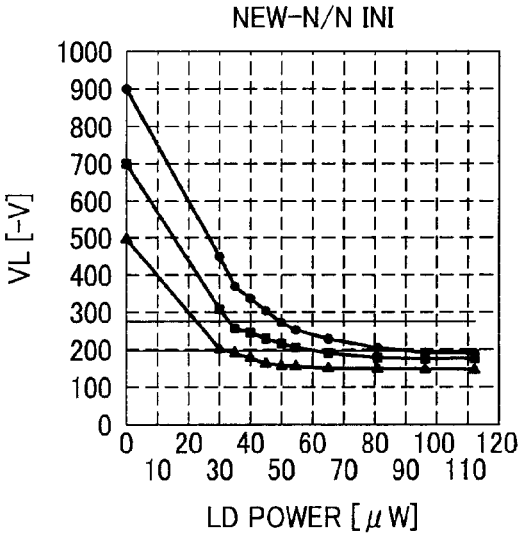
FIGS. 16A to 16C are graphs for explaining relations between the exposure amount and the exposed-area potential that is observed in a photosensitive element at an initial state in three environments (normal environment, low-temperature and low-humidity environment, and high-temperature and high-humidity environment)
Figure 16B:
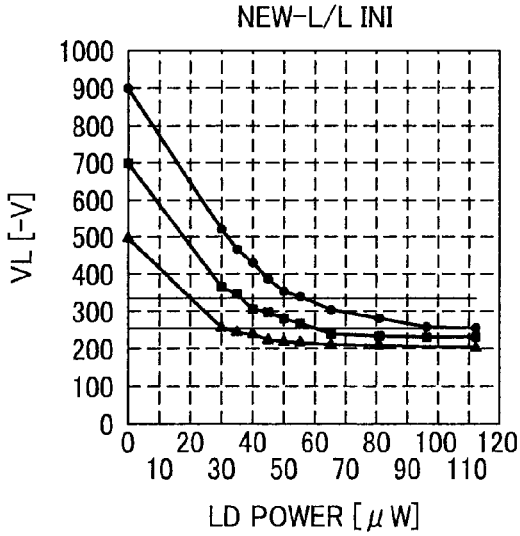
Figure 16C:
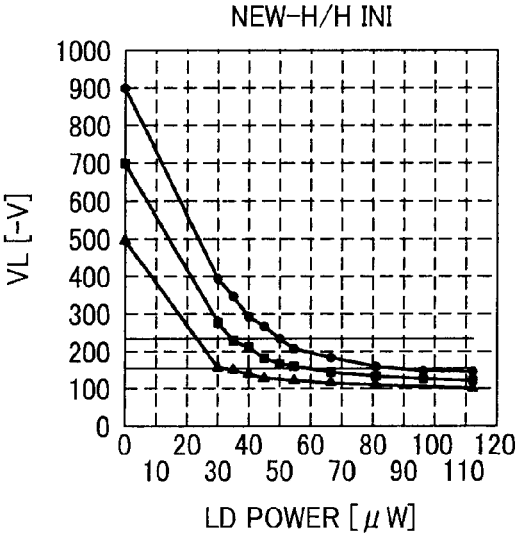
Figure 16D:
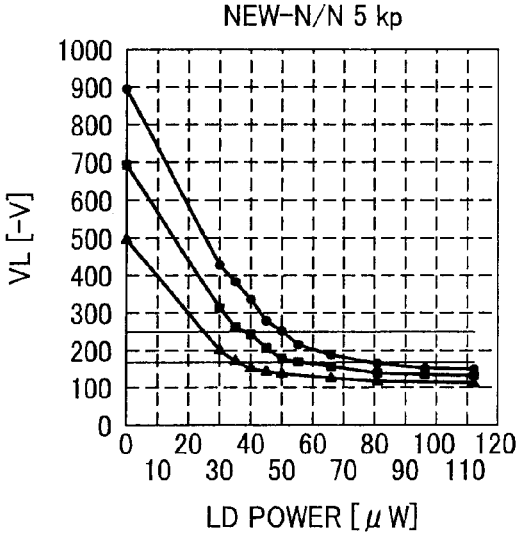
FIGS. 16D to 16F are graphs for explaining relations between the exposure amount and the exposed-area potential that is observed in the photosensitive element when 5000 sheets are printed in the three environments.
Figure 16E:
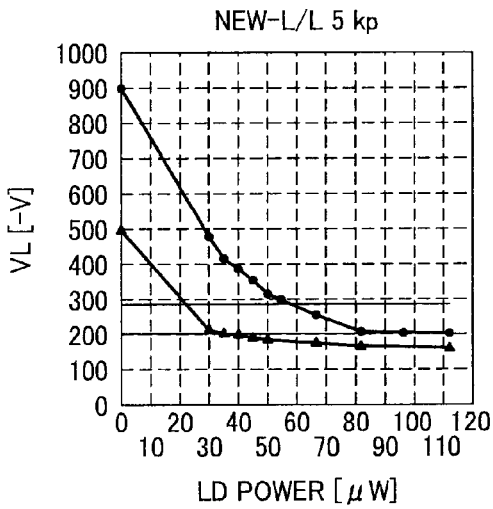
Figure 16F:
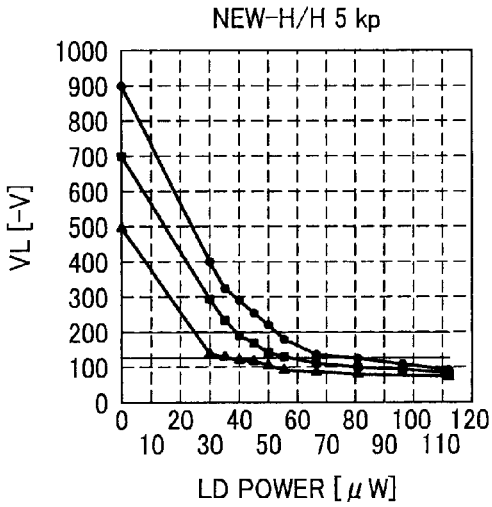
Figure 16G:
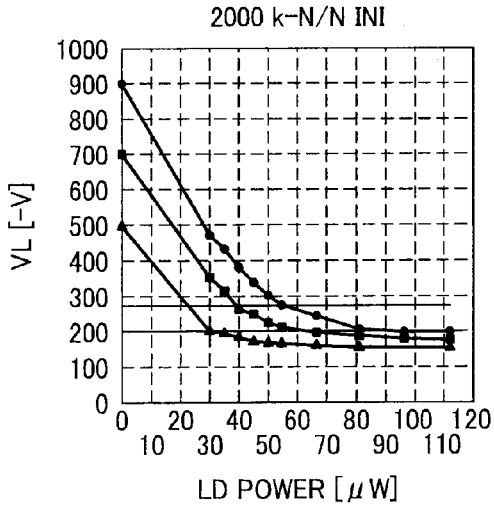
FIGS. 16G to 16I are graphs for explaining relations between the exposure amount and the exposed-area potential that is observed in the photosensitive element when 2000 thousand sheets are printed in the three environments.
Figure 16H:
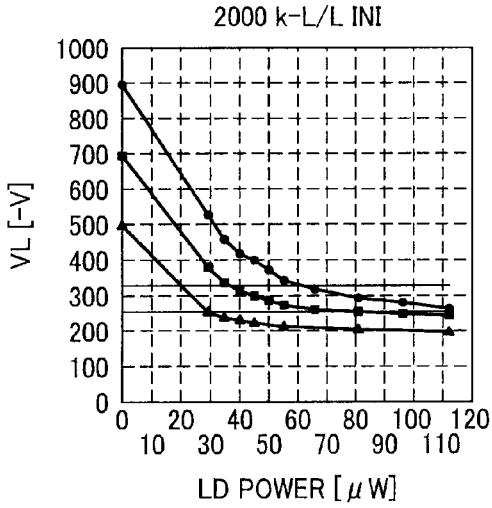
Figure 16I:
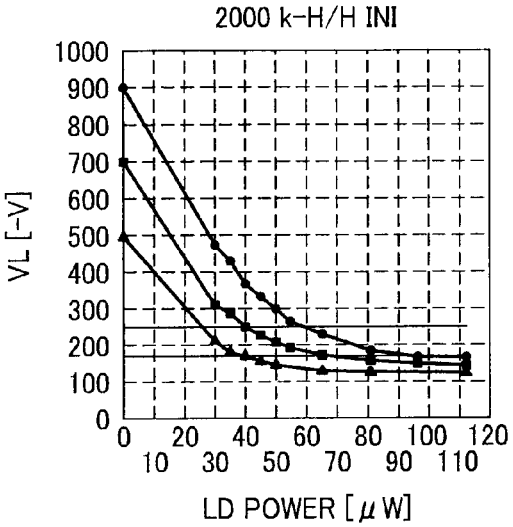
Figure 16J:
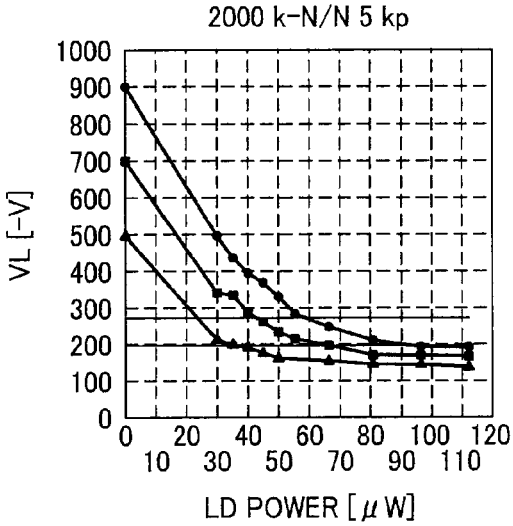
FIGS. 16J to 16L are graphs for explaining relations between the exposure amount and the exposed-area potential that is observed in the photosensitive element when 2000 thousand sheets are printed and 5000 sheets are printed in the three environments.
Figure 16K:
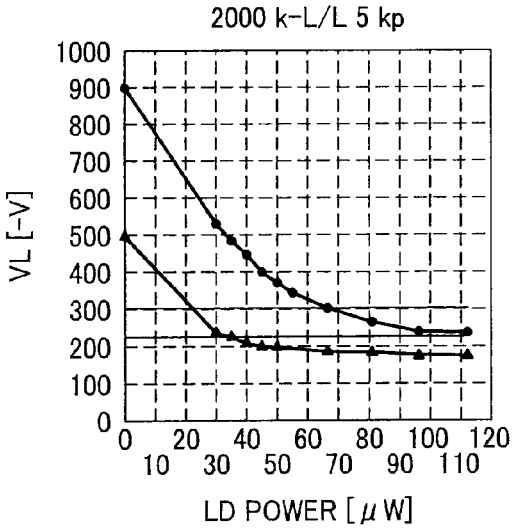
Figure 16L:
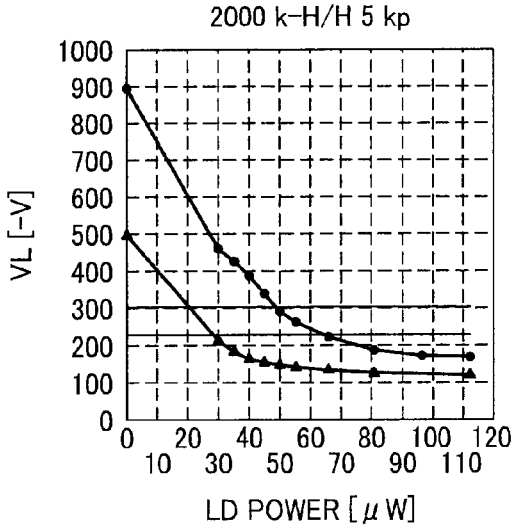

The photosensitive element 202 is a hard photosensitive element having the surface containing a filler. In the photosensitive element 202, a ratio of a decrease in the potential of the exposed area to an increase in the exposure amount decreases as the exposure amount increases, as illustrated in FIGS. 14A and 14B, in the same manner as the typical photosensitive element including the surface containing no filler. In the photosensitive element 202, as illustrated in FIG. 15, the residual exposed-area potential Vr gradually increases with the passage of time. Therefore, in the photosensitive element 202, the relation between the exposure power that is used for image formation and the exposed-area potential VL changes largely with the passage of time.

The charging unit 201 is a noncontact-type charging unit including a scorotron charger. To electrically charge the surface of the photosensitive element 202 to a target potential, a grid voltage (charging bias) Vg of the scorotron charger is set to a target potential (the target potential is assumed to be negative potential in the following description). It is allowable to use other noncontact-type chargers or contact-type chargers as the charging unit 201.

The writing unit 203 forms an electrostatic latent image dot by dot onto the surface of the photosensitive element 202 with a writing light L. More particularly, an LD, which is a light source, emits the pulsed writing light L to irradiate the photosensitive element 202. In the embodiment, the attached toner amount per 1-dot electrostatic latent image is controlled by the exposure time for forming a 1-dot electrostatic latent image (unit exposure time) so that a desirable image with various tones is formed. More particularly, an image with different sixteen tones can be formed with the tone control using sixteen different unit exposure times (hereinafter, "exposure duties 0 to 15"). The unit exposure time is zero at the exposure duty 0 and the unit exposure time is the maximum at the exposure duty 15.

The developing unit 205 includes a development roller opposed to the surface of the photosensitive element 202. The development roller corresponds to a developer carrier. The developing unit 205 supplies a two-component developer containing a toner and a magnetic carrier to the surface of the photosensitive element 202 by using the development roller with the polarized toner (negatively polarized toner in the embodiment) thereon. A developing bias Vb is applied to the development roller. An absolute value of the developing bias Vb is larger than the exposed-area potential VL and smaller than a charging potential Vd so that an electric field is produced in the electrostatic latent image (exposed area) on the photosensitive element 202. Because of this electric field, the toner on the development roller is electrostatically attracted toward the electrostatic latent image (exposed area) on the photosensitive element 202 and it is not attracted toward the no image portion (unexposed area). Thus, the electrostatic latent image is developed with toner.

In the image formation, the charging unit 201 charges the surface of the photosensitive element 202 so that the potential of the entire surface becomes the target potential (negative potential), firstly. Then, the light source (LD) of the writing unit 203 irradiates the photosensitive element 202 with the writing light L based on image data so that an absolute value of a potential of an area corresponding to the electrostatic latent image decreases, thereby forming the electrostatic latent image on the surface of the photosensitive element 202. After that, the developing unit 205 develops the electrostatic latent image (i.e., the exposed area in the embodiment) into the toner image with toner by using the development roller. More particularly, the toner image is formed in such a manner that the developing unit 205 applies the developing bias Vb, the absolute value of which is larger than the exposed-area potential VL and smaller than the charging potential Vd, to the development roller, so that the polarized toner (the negatively polarized toner in the embodiment) moves to the electrostatic latent image.

The toner image that is formed on the photosensitive element 202 is transferred onto the intermediate transfer belt 101 by the primary transfer device 106. After the primary transfer, the residual toner is removed from the intermediate transfer belt 101 by the photosensitive-element cleaner 206. After that, the neutralizer 207 irradiates a neutralizing light so that the entire surface of the photosensitive element 202 including the area corresponding to the no image portion is neutralized.

The toner images formed at the image forming units 102Y, 102M, 102C, 102K are primary-transferred onto the intermediate transfer belt 101 in a superimposed manner. After the primary transfer, the superimposed toner image is transferred from the intermediate transfer belt 101 onto the recording sheet 112 by the secondary transfer device 111. The toner image is then fixed to the recording sheet 112 by a fixing device (not shown), and thus a series of printing processes goes to end.

The process control for image stabilization by adjusting the attached toner amount per a 1-dot electrostatic latent image is described below.

The control of the charging bias Vg, the developing bias Vb, and the exposure power (hereinafter, "LD power") is described mainly for the simplicity.

It is assumed that the process control includes a control for adjusting the reference exposure amount employed at the writing unit 203 in image formation (hereinafter, "exposure-amount adjusting control"). However, the exposure-amount adjusting control can be performed separately from the process control.

Figure 3:
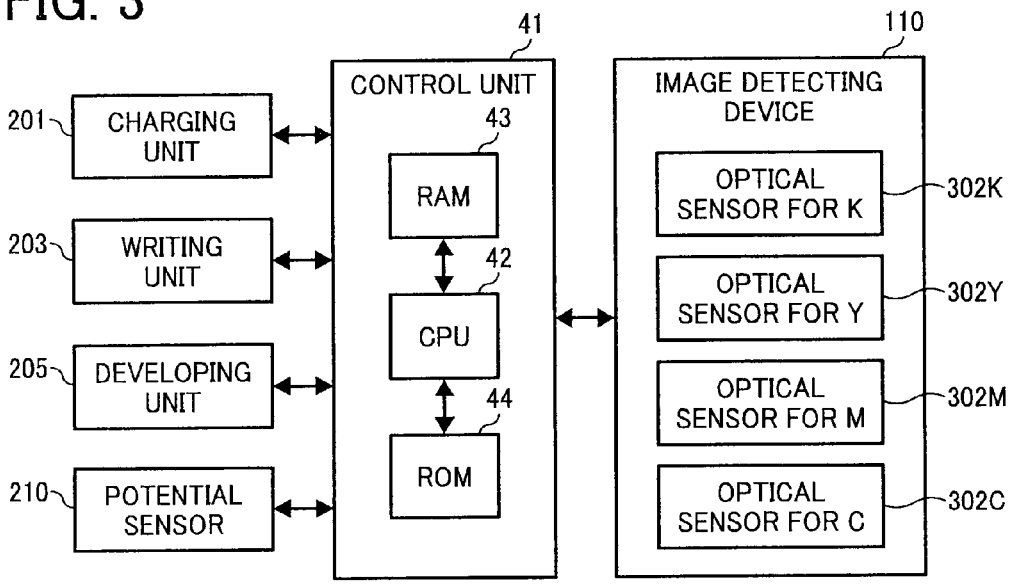
FIG. 3 is a block diagram of a control system used in a process control according to the embodiment.

FIG. 3 is a block diagram of a control system of the printer that performs the process control.

The control system includes the image detecting device 110, a control unit 41, the charging unit 201, the writing unit 203, the developing unit 205, and the potential sensor 210. The control unit 41 includes a random access memory (RAM) 43, a central processing unit (CPU) 42, and a read only memory (ROM) 44. The image detecting device 110 includes an optical sensor for K 302K, an optical sensor for Y 302Y, an optical sensor for M 302M, and an optical sensor for C 302C.

Figure 4A:
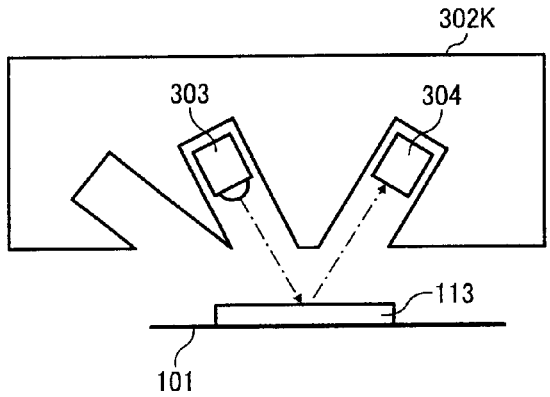
FIG. 4A is a schematic diagram of an optical sensor included in an image detecting device for black.
Figure 4B:
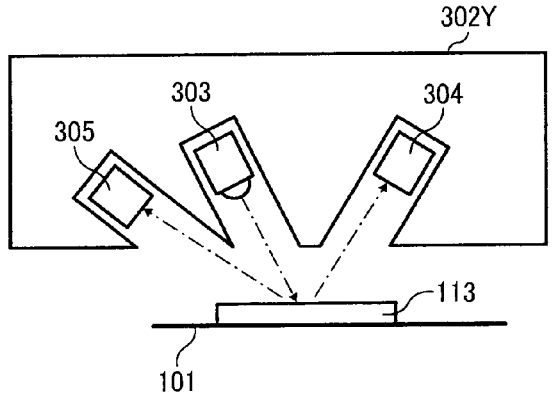
FIG. 4B is a schematic diagram of an optical sensor included in an image detecting device for color.
Figure 5:
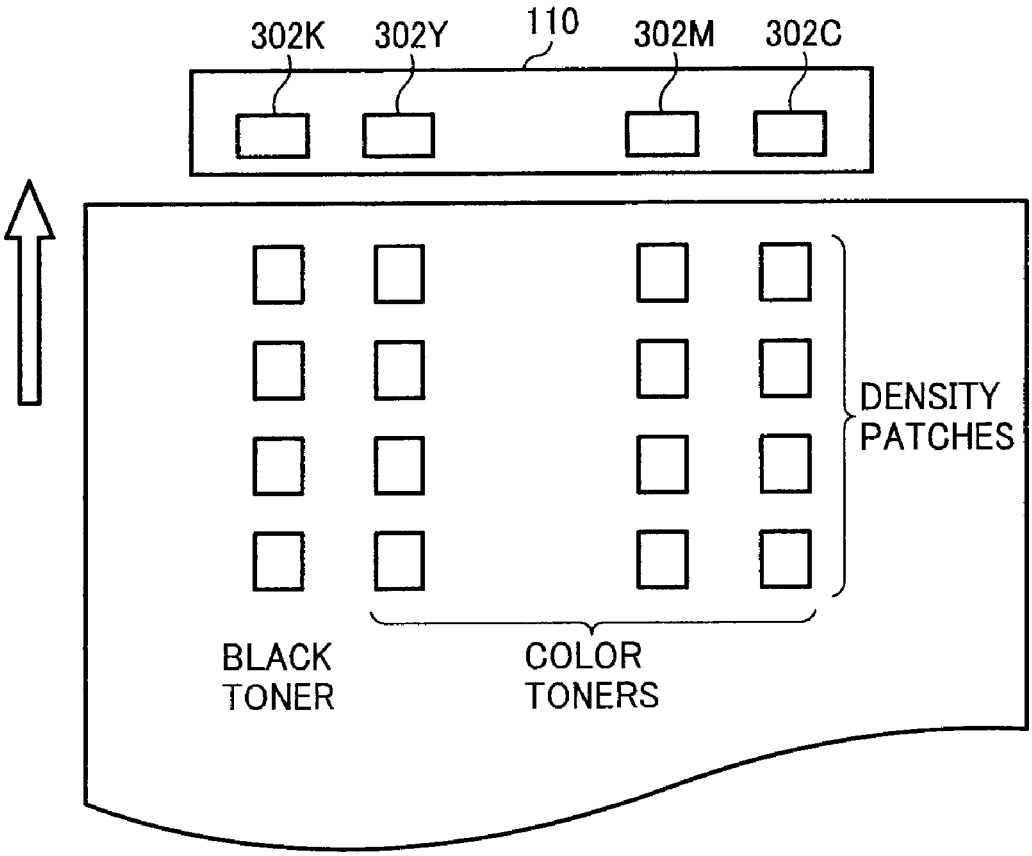
FIG. 5 is a schematic diagram for explaining arrangement of the optical sensors illustrated in FIGS. 4A and 4B.

In the process control, as shown in FIGS. 4A, 4B, and 5, the control system first forms a density patch 113 with each of black, yellow, magenta, and cyan toner on the intermediate transfer belt 101. The density patches 113 are toner patterns (toner images) that are formed under predetermined conditions and in the same manner as the normal image is formed. The optical sensors 302K, 302Y, 302M, 302C in the image detecting device 110 then detect an attached toner amount of the black, yellow, magenta, and cyan density patch 113, respectively.

The CPU 42 in the control unit 41 adjusts the grid voltage (charging bias) Vg of the charging unit 201, the developing bias Vb of the developing unit 205, and the LD power of the writing unit 203 based on the attached toner amounts detected by the image detecting device 110.

FIG. 4A is a schematic diagram of the optical sensor 302K. FIG. 4B is a schematic diagram of the optical sensor 302Y. The optical sensors 302M and 302C have the same or similar configuration as the optical sensor 302Y.

The optical sensor 302K includes a light-emitting element 303 that emits a light toward the surface of the intermediate transfer belt 101, and a specularly-reflected-light receiving element 304 that receives the light that is specularly reflected from the density patch 113 or the surface of the intermediate transfer belt 101. The optical sensor 302Y includes, in addition to the light-emitting element 303 and the specularly-reflected-light receiving element 304, a diffusely-reflected-light receiving element 305 that receives the light that is diffusely reflected from the density patch 113 or the surface of the intermediate transfer belt 101. The light-emitting element 303, the specularly-reflected-light receiving element 304, and a diffusely-reflected-light receiving element 305 in the optical sensors 302K, 302Y, 302M, 302C output a voltage signal representative of the intensity of the detected light. An arbitrary one of the optical sensors 302K, 302Y, 302M, 302C will be referred to as an optical sensor 302, or all of the optical sensors 302K, 302Y, 302M, 302C will be referred to as optical sensors 302.

As illustrated in FIG. 5, the optical sensors 302 are arranged at positions that are above the position from where the corresponding density patch 113 passes as the intermediate transfer belt 101 moves. The control unit 41 receives, after the start of writing with the writing light L, a voltage signal output from the specularly-reflected-light receiving element 304 and the diffusely-reflected-light receiving element 305 at the timing when the density patch 113 move below the optical sensor 302. The control unit 41 then calculates the attached toner amount of the density patch 113 based on the voltage indicated by the received voltage signal using a toner-amount conversion process. For example, a conversion table in which a relation between voltages and corresponding attached toner amounts are described is pre-stored in the ROM 44, and the control unit 41 determines the attached toner amount using the conversion table. Alternatively, the attached toner amount is calculated by converting the output voltage to the attached toner amount using a conversion equation.

Figure 6:
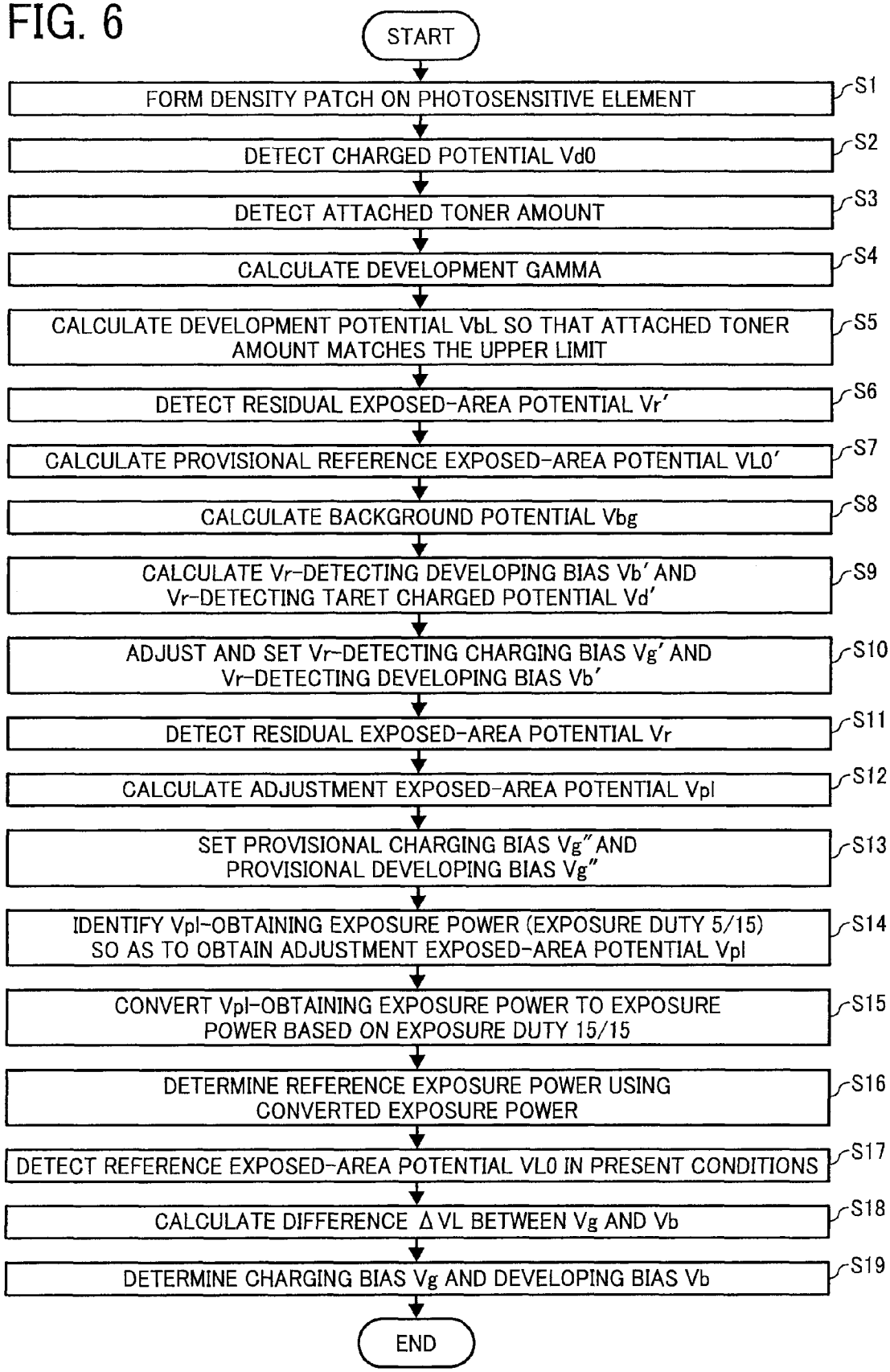
FIG. 6 is a general flowchart of the process control according to the embodiment.

FIG. 6 is a general flowchart of the process control. Assume that a gradational toner pattern is formed in the process control according to the embodiment in such a manner that the target attached toner amount ranges from about 0 mg/cm$^2$ to about 0.5 mg/cm$^2$ so that toner images with various densities from low to high can be formed on the recording sheet 112 properly.

In the process control after pre-processing step including correction of the image detecting device 110 and a defect check, a gradational density patch having ten different tones is formed on the surface of the photosensitive element 202 (Step S1) and the photosensitive element 202 is rotated about the central axis. The gradational density patch is formed under the current image formation conditions (that are set at the previous process control), e.g., a current charging bias Vg0, a current developing bias Vb0, and a current exposure power LDP (Step S1). The potential sensor 210 then detects a charging potential Vd0 that is a potential of the unexposed area (Step S2). The image detecting device 110 detects the attached toner amount of the gradational density patch (Step S3). A development gamma at the current state is calculated using the charging potential Vd0 that is detected at Step S2 and the attached toner amount that is detected at Step S3 (Step S4).

Figure 7:
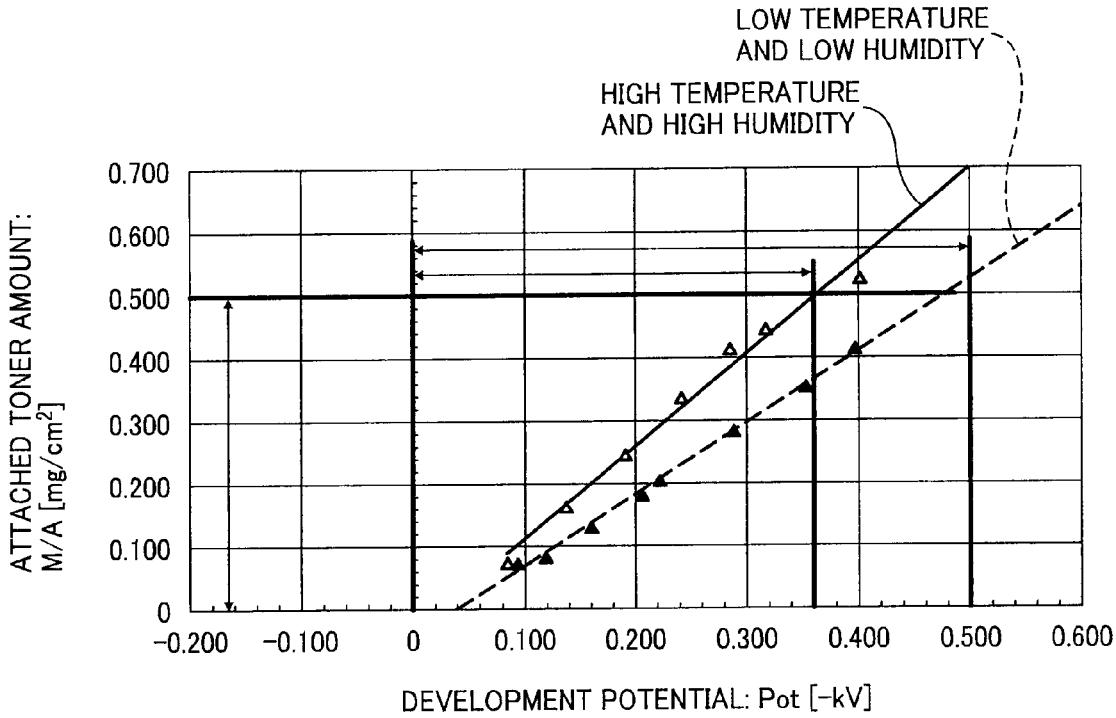
FIG. 7 is a graph based on actual measurements for explaining relations between attached toner amount of gradational toner patterns and development potential, in which the gradational toner patterns are formed both in a high-temperature and high-humidity environment and in a low-temperature and low-humidity environment.

FIG. 7 is a graph of attached toner amount and development potential obtained with actual measurements. Measurements were performed with two types of gradational toner patterns. One gradational toner pattern was formed in a high-temperature (32° C.) and high-humidity environment (54%) while the other gradational toner pattern was formed in a low-temperature (10° C.) and low-humidity environment (15%). The horizontal axis of the graph represents development potential, and the vertical axis represents attached toner amount. The development gamma is a parameter indicative of a slope of this graph, i.e., representing the relation between the development potential and the attached toner amount. The development potential is a difference between the exposed-area potential VL on the photosensitive element 202 and the developing bias Vb. As the development potential increases, both the attached toner amount per 1-dot electrostatic latent image and the image density increase. A later-described background potential is a difference between the charging potential Vd and the developing bias Vb. If the background potential is too small, the toner may get attached even to the unexposed area, which causes ink scumming. If the background potential is too large, even the magnetic carrier contained in the developer may get attached to the surface of the photosensitive element 202.

In the high-temperature high-humidity example illustrated in FIG. 7, the development potential 360 volts (V) is needed to form the density patch having the attached toner amount 0.5 mg/cm$^2$, which is the upper limit of the target attached toner amount in the embodiment. In contrast, in the low-temperature and low-humidity example illustrated in FIG. 7, the development potential 500 V is needed to form the density patch having the attached toner amount 0.5 mg/cm$^2$. That is, the development potential required to form the density patch having the same attached toner amount, i.e., 0.5 mg/cm$^2$, is different depending on the temperature and humidity. This is because an amount of electric charge on the toner is generally small in a high-temperature and high-humidity environment, while an amount of electric charge on the toner is generally large in a low-temperature and low-humidity environment. Therefore, even if the development potential is the same, the attached toner amount is large in the high-temperature and high-humidity environment, while the attached toner amount is small in the low-temperature and low-humidity environment.

Accordingly, it is necessary to adjust the development potential depending on the temperature and humidity to obtain the target image density (i.e., the target attached toner amount). The development potential corresponding to the target attached toner amount can vary depending on factors other than temperature and humidity. Therefore, it is necessary to determine the image formation conditions (the charging bias Vg, the developing bias Vb, and the reference exposure amount (the reference exposure power and the reference exposure duty)) by checking the current development gamma at a suitable time and calculating the development potential corresponding to the target attached toner amount using the development gamma.

For these reasons, a development potential VbL corresponding to the attached toner amount 0.5 mg/cm$^2$, which is the upper limit of the target attached toner amount, is calculated using the development gamma that is calculated at Step S4 (Step S5). After that, the image formation conditions are adjusted in such a manner that the image having the attached toner amount 0.5 mg/cm$^2$ can be formed at the development potential VbL. The adjustment is described in detail below.

In the embodiment, the surface of the photosensitive element 202 is exposed under the conditions of the current charging bias Vg0, the current development bias Vb0, an exposure power LDP', and the exposure duty 15. The exposure power LDP' is 1.5 times (150%) stronger than a reference exposure power LDP0. The exposure duty 15 is the maximum exposure duty. After that, a potential of an electrostatic latent image (exposed area) that is formed under the above conditions is detected as a residual exposed-area potential Vr' by the potential sensor 210 (Step S6). The residual exposed-area potential Vr' is used to calculate a developing bias and a charging potential that are used to detect the final residual exposed-area potential Vr (hereinafter, "Vr-detecting developing bias Vb'" and "Vr-detecting target potential Vd'", respectively).

A reference exposed-area potential VL0' is a provisional value. The reference exposed-area potential VL0' is calculated using Equation (1) and the residual exposed-area potential Vr' that is detected at Step S6 (Step S7). The reference exposed-area potential is a potential of the exposed area that is subjected to the writing light L at the reference exposure amount (the reference exposure power LDP and the reference exposure duty).

$$VL0'=Vr'-50 \quad (1)$$

As is clear from Equation (1), the reference exposed-area potential VL0' is calculated by adding −50 V to the residual exposed-area potential Vr'. This is because it has been widely known empirically that the reference exposed-area potential is close to a value that is calculated by adding −50 V to the residual exposed-area potential Vr'. The provisional reference exposed-area potential VL0' is corrected to the actual reference exposed-area potential VL0 in a later-described correction process.

The Vr-detecting developing bias Vb', which is used to detect the final residual exposed-area potential Vr, is calculated using Equation (2) and the provisional reference exposed-area potential VL0':

$$Vb'=VbL+VL0' \quad (2)$$

The Vr-detecting target potential Vd' is then calculated using Equation (3) and the Vr-detecting developing bias Vb' that is calculated using Equation (2):

$$Vd'=Vb'+Vbg \quad (3)$$

where Vbg is background potential. The background potential Vbg of Equation (3) is variable depending on the development potential VbL, while the background potential is fixed (e.g., 200 V) in the conventional calculation. The reason why the background potential Vbg is variable will be described later. The background potential Vbg is calculated using Equation (4) (Step S8):

$$Vbg=VbL\times\alpha \quad (4)$$

where α is ratio of the background potential Vbg to the development potential VbL (hereinafter, "background-potential coefficient"). The background-potential coefficient a is calculated experimentally from the following viewpoint.

Table 1 shows results of experiments using which the background-potential coefficient α is determined and conditions under which the experiments are conducted.

During these experiments, additional toner is not supplied and various image formation conditions are unchanged. Various parameters are set in such a manner that the charging potential Vd is about 900 V, firstly. Furthermore, under the conditions of different background potentials as illustrated in Table 1, the developing bias Vb and the exposure power are adjusted to meat the experimental conditions illustrated in Table 1. The toner is supply to such an extent that a black image having an image density (ID) 1.6 is formed. A line-width check image having a 1-dot line is then formed under the condition of toner able to form the black image having the image density 1.6. The line-width check image that is formed on the surface of the photosensitive element 202 is detected, and an attached toner amount is measured. Furthermore, a halftone image is formed and a density of the halftone image is measured. These experiments were conduct in the same manner with the different charging potentials Vd about 700 V and about 500 V.

Figure 8A:
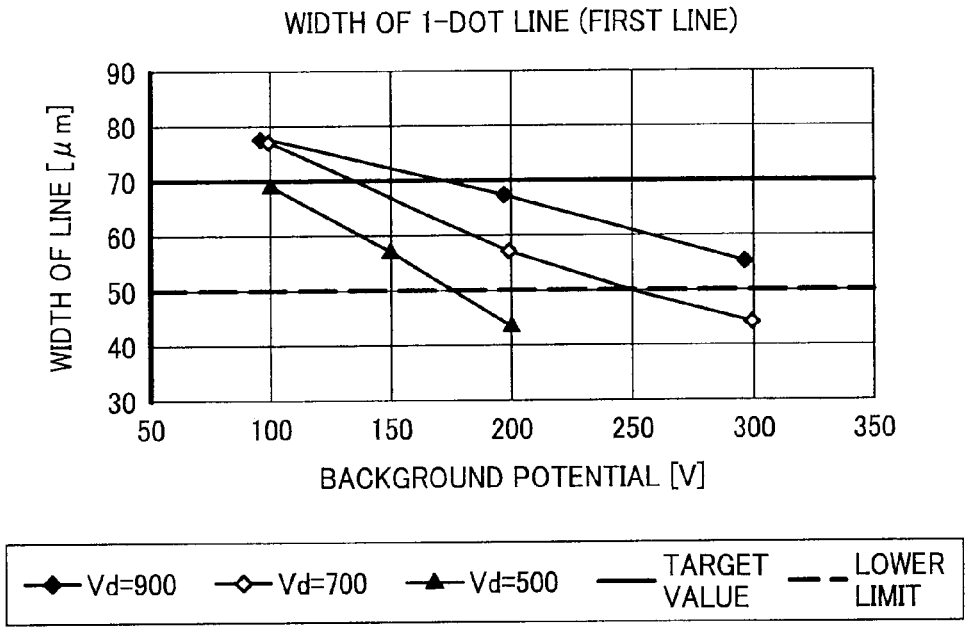
FIGS. 8A and 8B are graphs for explaining relations between background potential and width of a 1-dot line that extends in a direction in which a surface of a photosensitive element moves, where the line is formed at various potentials 900 volts (V), 700 V, and 500 V.
Figure 8B:
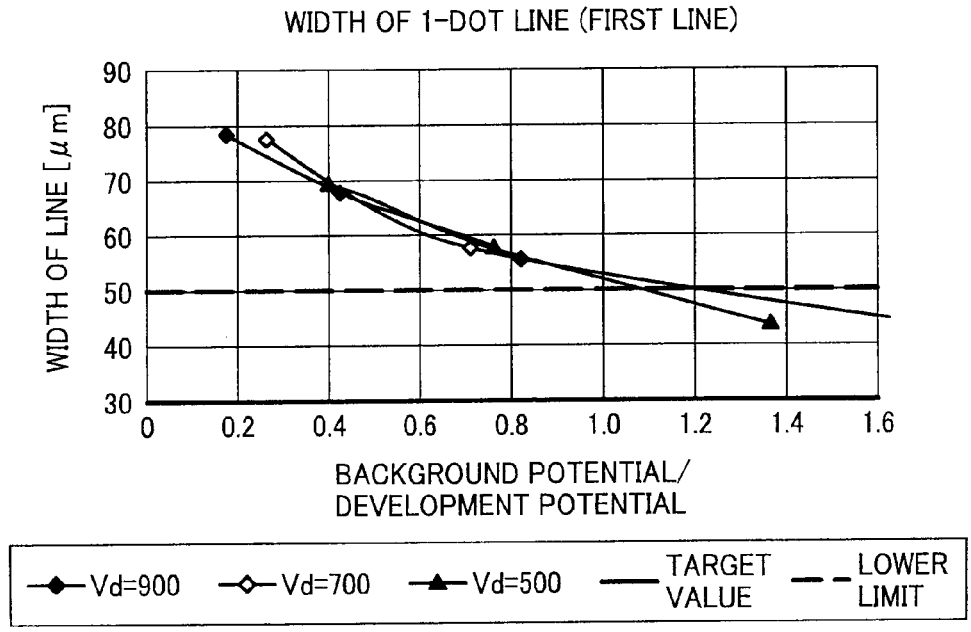

FIGS. 8A and 8B are graphs for explaining relations between the background potential and width of a 1-dot line that extends in a direction in which the surface of the photosensitive element 202 moves (hereinafter, "first line") where the first line is formed at the various potentials Vd 900 V, 700 V, and 500 V. The horizontal axis of FIG. 8A is the background potential. The horizontal axis of FIG. 8B is the ratio of the background potential to the development potential.

Figure 9A:
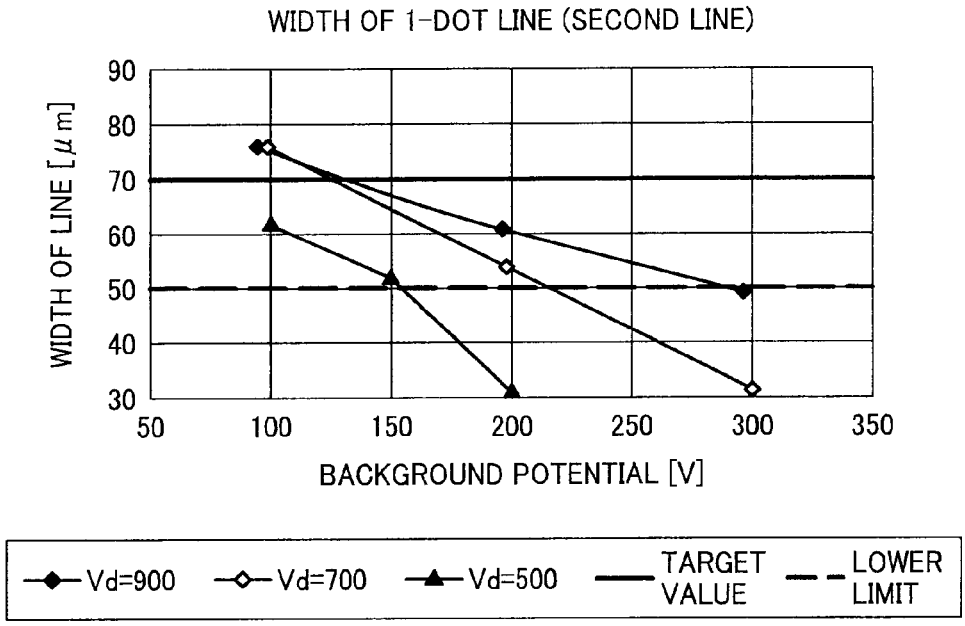
FIGS. 9A and 9B are graphs for explaining relations between the background potential and the width of a 1-dot line that extends in a direction perpendicular to the direction in which the surface of the photosensitive element moves, where the line is formed at the various potentials 900 V, 700 V, and 500 V.
Figure 9B:
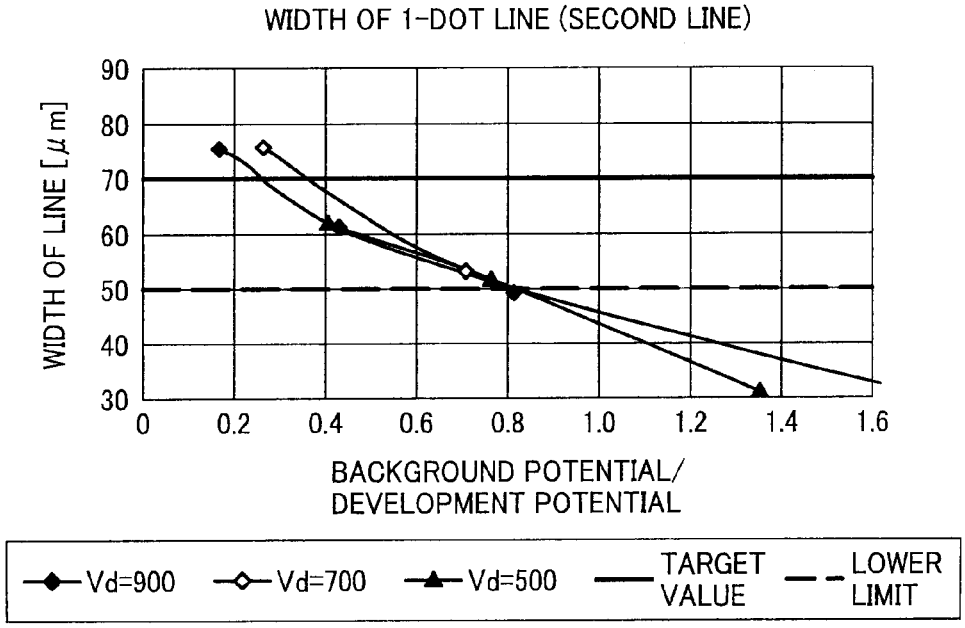

FIGS. 9A and 9B are graphs for explaining relations between the background potential and width of a 1-dot line that extends in a direction perpendicular to the direction in which the surface of the photosensitive element 202 moves (hereinafter, "second line"), where the second line is formed at the various potentials Vd 900 V, 700 V, and 500 V. The horizontal axis of FIG. 9A is the background potential. The horizontal axis of FIG. 9B is the ratio of the background potential to the development potential.

In the examples illustrated in FIGS. 8A, 8B, 9A, and 9B, the development gamma and the development potential are adjusted to set the attached toner amount (image density) to 0.5 mg/cm$^2$, which is the upper limit of the target attached toner amount, even though the background potential varies.

As it is clear from FIGS. 8A and 9A, even when the development potential is adjusted to maintain the attached toner amount unchanged, the width of the line changes depending on a difference in the background potential regardless of a difference in the charging potential Vd. This is because effects of an electric field between the unexposed area and the development roller (hereinafter, "background electric field") on a manner in which the toner moves to a border between the

TABLE 1

| | Vd = 900 | | | Vd = 700 | | | Vd = 500 | | |
|---|---|---|---|---|---|---|---|---|---|
| Background P [V] | 96 | 198 | 296 | 99 | 199 | 299 | 100 | 150 | 200 |
| Vg [−V] | −870 | −870 | −870 | −670 | −670 | −670 | −460 | −460 | −460 |
| Vd [−V] | −896 | −896 | −896 | −699 | −699 | −699 | −500 | −500 | −500 |
| Vb [−V] | −800 | −700 | −600 | −600 | −500 | −400 | −400 | −350 | −300 |
| VL [−V] | −237 | −237 | −237 | −218 | −218 | −218 | −153 | −153 | −153 |
| LD power [μW] | 117 | 117 | 117 | 88 | 88 | 88 | 71 | 71 | 71 |
| VbL | 563 | 463 | 363 | 382 | 282 | 182 | 247 | 197 | 147 |
| Vbg | 0.171 | 0.423 | 0.815 | 0.259 | 0.706 | 1.643 | 0.405 | 0.761 | 1.361 |
| Development γ | 1.29 | 1.37 | 1.46 | 1.65 | 1.83 | 2.08 | 2.05 | 2.51 | 2.68 |
| Width of 1-dot line (first line) | 78.48 | 67.77 | 55.60 | 77.53 | 57.27 | 44.30 | 69.45 | 57.50 | 43.78 |
| Width of 1-dot line (second line) | 76.13 | 61.04 | 49.28 | 76.22 | 53.56 | 31.58 | 62.28 | 51.99 | 31.08 |
| Halftone density (1200 dpi 2 by 2) | 0.201 | 0.159 | 0.13 | 0.189 | 0.138 | 0.089 | 0.158 | 0.123 | 0.096 |

exposed area and the unexposed area are assumed to be various depending on the background potential. More particularly, if the background electric field is strong, because the toner strongly pulled by the development roller, only a small amount of the toner or no toner is attached to the border between the exposed area and the unexposed area. This decreases a ratio of an area where the toner is attached to an area of the exposed area, so that a thin line is formed leading to a low-quality image. On the other hand, if the background electric field is week, the ratio of the area where the toner is attached to the area of the exposed area is small. As a result, a thicker line is formed again leading to a low-quality image.

As described above, in the examples illustrated in FIGS. 8A and 9A, the development potential is adjusted such that the attached toner amount does not change. However, if the background potential is fixed (e.g., 200 V) as in the conventional method, a line having constant width cannot be formed, i.e., the width of the line changes as the charging potential Vd changes. As described above, the development potential is adjusted to maintain the attached toner amount unchanged in the process control according to the embodiment. Therefore, if the fixed background potential is used, the width of the line fluctuates and the low-quality images are formed. With the usage of the specific photosensitive element 202, the residual exposed-area potential Vr increases gradually with the passage of time. Accordingly, to maintain the attached toner amount unchanged regardless of the passage of time, it is necessary to gradually increase the developing bias with the passage of time for the suitable development potential. Furthermore, with the increase of the developing bias, because the background potential is fixed, the charging potential Vd increases gradually with the passage of time. As a result, if the background potential is a fixed value (e.g., 200 V), the width of the line decreases with the passage of time and the image is degraded.

As it is clear from FIGS. 8B and 9B, even when the development potential is adjusted to maintain the attached toner amount unchanged, if the ratio of the background potential to the development potential is fixed, the width of the line is fixed regardless of the charging potential Vd. This is because the effect of the electric field between the exposed area and the development roller on the manner in which the toner is attached to the border between the exposed area and the unexposed area and the effect of the background electric field between the unexposed area and the development roller become stable because of the fixed ratio, as a result of which the ratio of the area where the toner is attached to the area of the exposed area is scarcely changed, i.e., independent from changes of the development potential and the background potential.

In this manner, it is possible to suppress the image degradation due to the change of the width of the line with the fixed image density by adjusting the background potential so that the ratio of the background potential to the development potential (background-potential coefficient) is maintained unchanged while setting the development potential to maintain the attached toner amount unchanged.

Figure 10A:
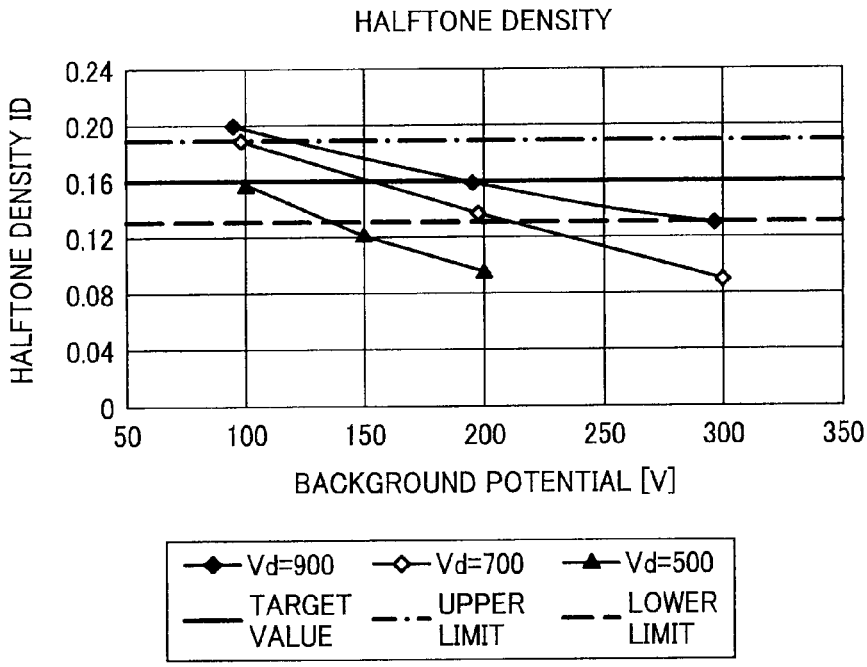
FIG. 10A is a graph for explaining relations between the background potential and halftone density with the different potentials 900 V, 700 V, and 500 V.
Figure 10B:
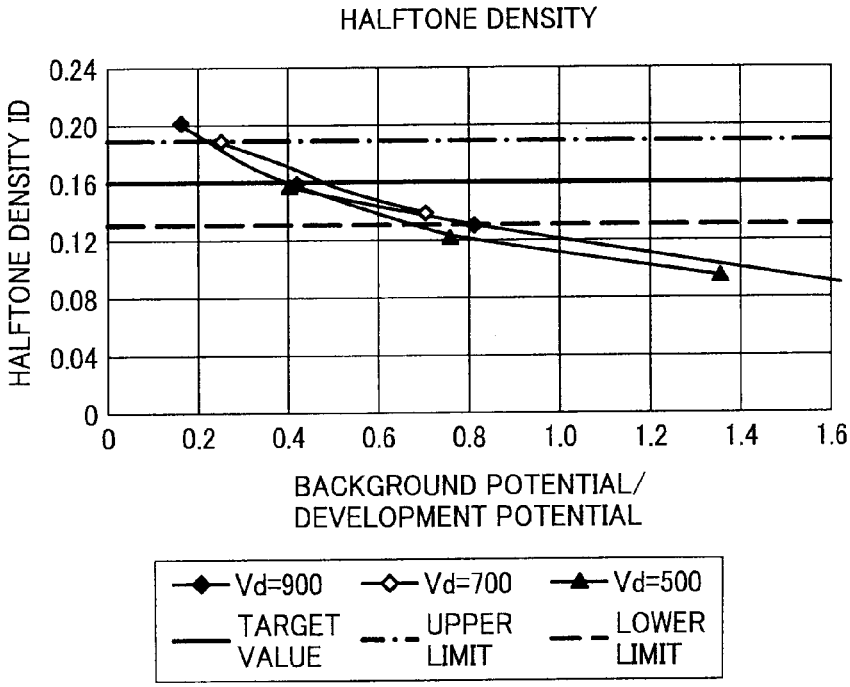
FIG. 10B is a graph for explaining relations between a ratio of the background potential to the development potential and the halftone density with the different potentials 900 V, 700 V, and 500 V.

FIG. 10A is a graph for explaining a relation between the background potential and the halftone density based on the results of the above-described experiments with the different potentials Vd 900 V, 700 V, and 500 V. FIG. 10B is a graph for explaining relations between the ratio of the background potential to the development potential and the halftone density based on the results of the above-described experiments with the different potentials Vd 900 V, 700 V, and 500 V.

It is clear from FIG. 10A that even if the development potential is adjusted so that the black image is formed at the fixed attached toner amount, if the background potential is fixed (e.g., 200 V) as in the conventional method, the halftone density fluctuates depending on the charging potential Vd. Because the development potential is adjusted to maintain the attached toner amount of the black image unchanged in the same manner as in the process control according to the embodiment, if the background potential is fixed, the halftone density fluctuates, which changes the image quality. With the usage of the specific photosensitive element 202, the charging potential Vd is adjusted to gradually increase with the passage of time. Therefore, if the background potential is fixed (e.g., 200 V) the halftone density decreases with the passage of time and thereby the image is degraded.

On the other hand, it is clear from FIG. 10B that in the case where the development potential is adjusted to maintain the attached toner amount of the black image unchanged, if the ratio of the background potential to the development potential is fixed, the halftone density is unchanged even if the charging potential Vd fluctuates. The reason is the same as in the reason described above about the width of the line.

In this manner, it is possible to suppress the image degradation due to the change of the halftone density regardless of the fixed image density by adjusting the background potential so that the ratio of the background potential to the development potential (background-potential coefficient) is maintained unchanged while setting the development potential to maintain the attached toner amount unchanged.

According to the results of the experiments, to suppress the image degradation due to the above-described reasons, the ratio of the background potential to the development potential, i.e., the background-potential coefficient $\alpha$ is to be set from 0.40 to 0.80, preferably, from 0.40 to 0.45. In the embodiment, the background-potential coefficient $\alpha$ is set to 0.40.

The background potential Vbg is calculated by multiplying background-potential coefficient $\alpha$ by the development potential VbL that is calculated at Step S5 using Equation (4). As described above, if the background potential Vbg is too small, the ink scumming may appear. If the background potential Vbg is too large, the carrier may get attached to the surface of the photosensitive element 202. Therefore, it is preferable to set the background potential Vbg to a value so that defects that are more serious than the change of the width of the line and the halftone density, such as the ink scumming and the carrier attachment, cannot occur.

To avoid the ink scumming and the carrier attachment, the background potential Vbg is set in the following manner in the embodiment. Assume that if the background potential Vbg is from a lower limit $Vbg_{MIN}$ to an upper limit $Vbg_{MAX}$, the ink scumming and the carrier attachment cannot occur. If the background potential Vbg that is calculated using Equation (4) is larger than the upper limit $Vbg_{MAX}$, the upper limit $Vbg_{MAX}$ is used instead of the calculated background potential Vbg in the subsequent steps as the background potential Vbg. If the background potential Vbg that is calculated using Equation (4) is smaller than the lower limit $Vbg_{MIN}$, the lower limit $Vbg_{MIN}$ is used instead of the calculated background potential Vbg in the subsequent steps as the background potential Vbg.

After that, the Vr-detecting developing bias Vb', which is used to detect the final residual exposed-area potential Vr, is calculated using Equation (2) and the provisional reference exposed-area potential VL0' that is calculated at Step S7 (Step S9). The Vr-detecting target potential Vd' is calculated using Equation (3) and the Vr-detecting developing bias Vb' that is calculated using Equation (2) and the background potential Vbg that is calculated at Step S8 (Step S9).

A Vr-detecting charging bias Vg' is a charging bias that is used to detect the target residual exposed-area potential Vr. The Vr-detecting charging bias Vg' is set in such a manner that the charging potential becomes the Vr-detecting target potential Vd' (Step S10).

More particularly, the surface of the photosensitive element 202 is charged with the charging bias being set to a fixed value (−550 V in the embodiment) and the developing bias being set to a fixed value (−350 V in the embodiment). The charging potential of the surface is then detected by the potential sensor 210. If the charging potential is within a target range around the Vr-detecting target potential Vd' (within a range from Vd'−5 to Vd'+5 in the embodiment), the Vr-detecting charging bias Vg' is set to the fixed value that is used for the detection (−550 V).

On the other hand, if the detected charging potential is out of the target range, it is calculated a linear approximate equation indicative of a relation between the current charging bias and the current charging potential using the fixed value of the charging bias (−550 V) and the result of the detection (the charging potential) and the charging bias used in the pre-process prior to the process control (−700 V in the embodiment) and the charging potential that is detected by the potential sensor 210 at the pre-process based on a first-order approximation and a least-square approach. After that, a Vr-detecting charging bias corresponding to the Vr-detecting target potential Vd' is identified using the linear approximate equation. The surface of the photosensitive element 202 is then charged with the identified Vr-detecting charging bias and the charging potential is detected by the potential sensor 210, again. If the detected charging potential is within the target range, the identified Vr-detecting charging bias is determined to be the Vr-detecting charging bias Vg'. If the detected charging potential is out of the target range, it is further calculated a linear approximate equation indicative of a relation between the charging bias and the charging potential using the result of this detection. The same process is repeated until the charging potential within the target range is detected.

In most cases, the permissible charging bias is limited by the specifications of the charging unit 201 or the like. In the embodiment, the permissible charging bias is from −450 V to −900 V. Therefore, if the calculated Vr-detecting charging bias Vg' is larger than the upper limit of the available charging biases ($Vg_{MAX}$=−900 V), the Vr-detecting charging bias Vg' is set to the upper limit $Vg_{MAX}$ instead of the calculated Vr-detecting charging bias Vg'. If the calculated Vr-detecting charging bias Vg' is smaller than the lower limit of the available charging biases ($Vg_{MIN}$=−450 V), the Vr-detecting charging bias Vg' is set to the lower limit $Vg_{MIN}$ instead of the calculated Vr-detecting charging bias Vg'.

The Vr-detecting developing bias Vb' is corrected based on the Vr-detecting charging bias Vg' that is determined in such a manner that the background potential becomes the background potential Vbg that is calculated at Step S8 (Step S10).

Figure 11:
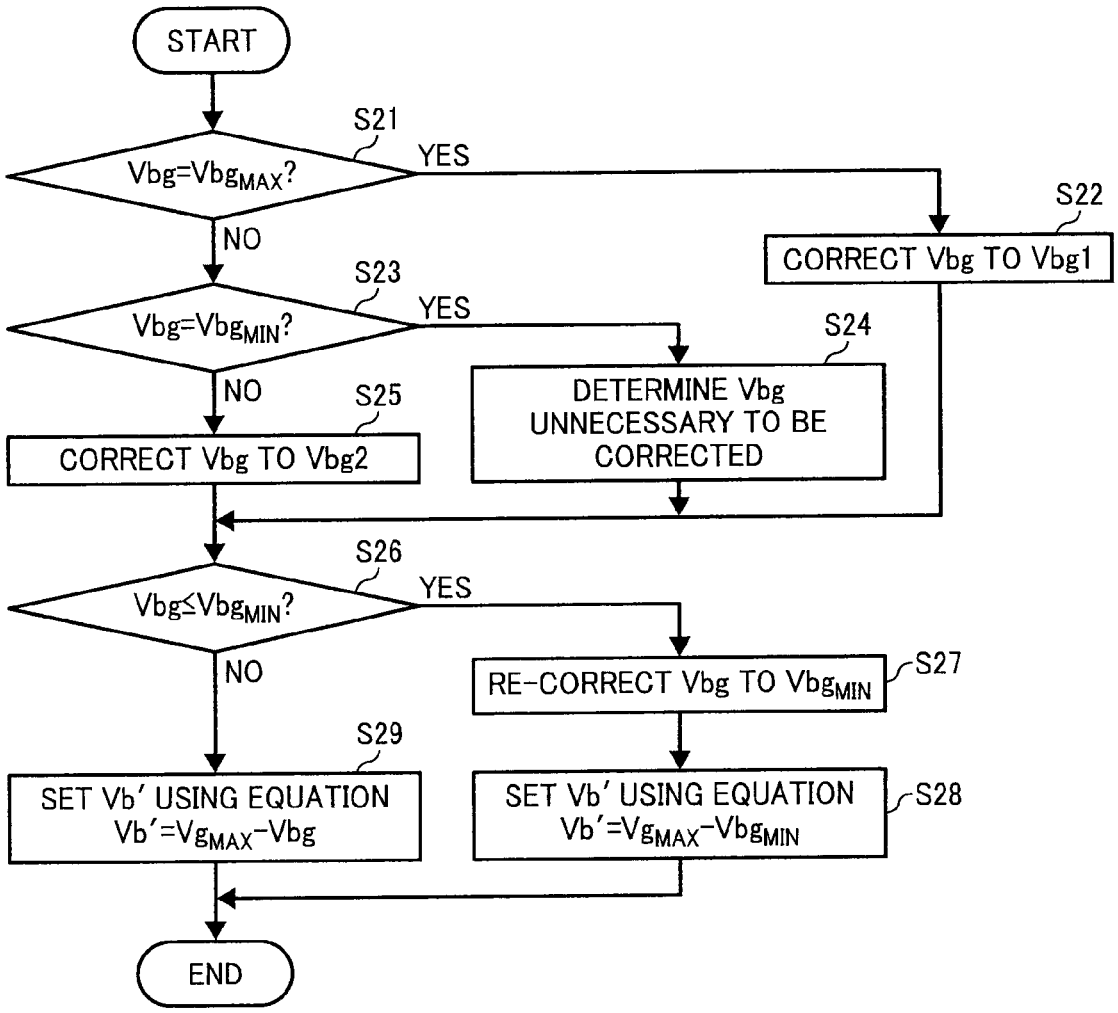
FIG. 11 is a flowchart of a process of correcting a Vr-detecting developing bias when a Vr-detecting charging bias is set to an upper limit.
Figure 12:
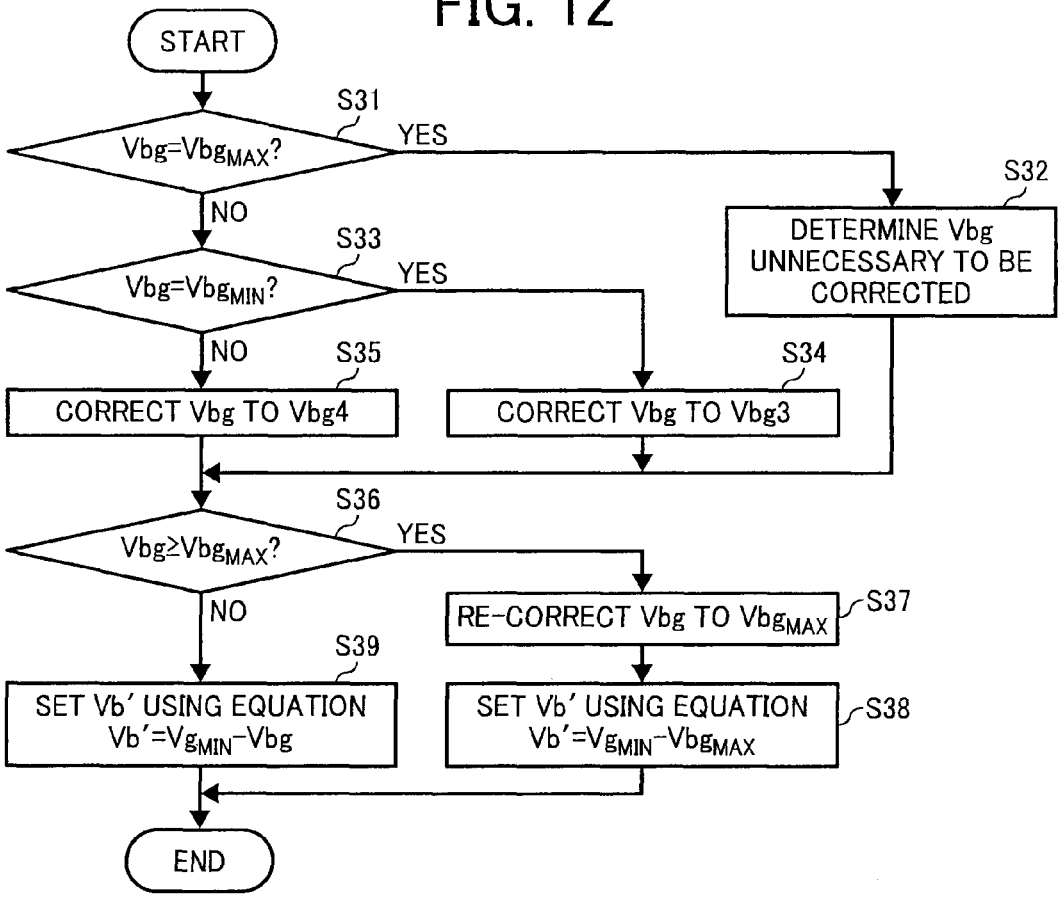
FIG. 12 is a flowchart of a process of correcting the Vr-detecting developing bias when the Vr-detecting charging bias is set to a lower limit.

FIG. 11 is a flowchart of a process of correcting the Vr-detecting developing bias Vb' when the Vr-detecting charging bias Vg' is set to the upper limit $Vg_{MAX}$. FIG. 12 is a flowchart of a process of correcting the Vr-detecting developing bias Vb' when the Vr-detecting charging bias Vg' is set to the lower limit $Vg_{MIN}$.

Figure 13:
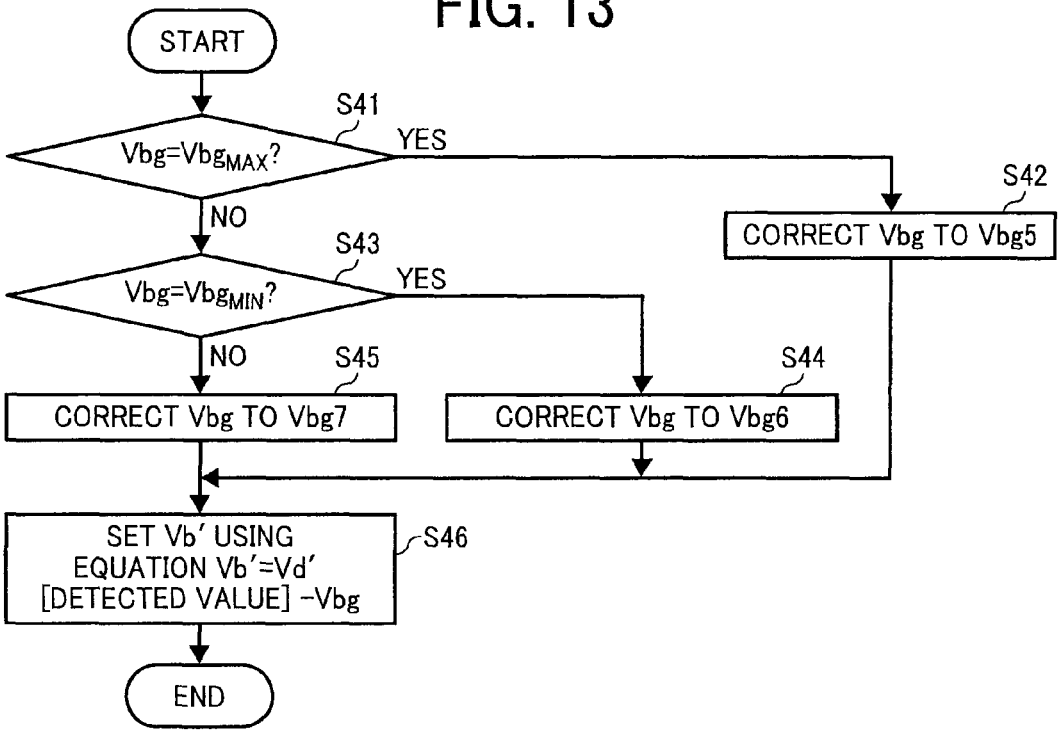
FIG. 13 is a flowchart of a process of correcting the Vr-detecting developing bias when the Vr-detecting charging bias is set between the upper limit and the lower limit.

FIG. 13 is a flowchart of a process of correcting the Vr-detecting developing bias Vb' when the Vr-detecting charging bias Vg' is set between the upper limit $Vg_{MAX}$ and the lower limit $Vg_{MIN}$.

In the case of FIG. 11 where the Vr-detecting charging bias Vg' is set to the upper limit $Vg_{MAX}$, if the background potential Vbg is set to the upper limit $Vbg_{MAX}$ (Yes at Step S21), the background potential Vbg is corrected to a background potential Vbg1 using Equation (5) (Step S22):

$$Vbg=Vbg1=Vbg_{MAX}-(Vd'\text{ [calculated value]}-Vg_{MAX})\times\beta 1 \quad (5)$$

where Vd' [calculated value] is the Vr-detecting target potential Vd' that is calculated at Step S9 different from the charging potential Vd' [detected value] that is detected at Step S10; β1 is a coefficient that is used to maintain the ratio of the background potential to the development potential unchanged when the charging bias is an available value. The coefficient β1 is generally set equal to the background-potential coefficient α.

If the background potential Vbg is set to the lower limit $Vbg_{MIN}$ (Yes at Step S23), the background potential Vbg of the lower limit $Vbg_{MIN}$ is used as it is without correcting the background potential Vbg (Step S24).

If the background potential Vbg is set between the upper limit $Vbg_{MAX}$ and the lower limit $Vbg_{MIN}$ (No at Step S23), the background potential Vbg is corrected to a background potential Vbg2 using Equation (6) (Step S25):

$$Vbg=Vbg2=Vbg-(Vd'\text{ [calculated value]}-Vg_{MAX})\times\beta 1 \quad (6)$$

If the background potential Vbg is equal to or smaller than the lower limit $Vbg_{MIN}$ (Yes at Step S26), the background potential Vbg is set to the lower limit $Vbg_{MIN}$ (Step S27). After that, the Vr-detecting developing bias Vb' is corrected to a value calculated using Equation (7) (Step S28):

$$Vb'=Vg_{MAX}-Vbg_{MIN} \quad (7)$$

If the background potential Vbg is between the upper limit $Vbg_{MAX}$ and the lower limit $Vbg_{MIN}$ (No at Step S26), the Vr-detecting developing bias Vb' is corrected to a value calculated using Equation (8) (Step S29):

$$Vb'=Vg_{MAX}-Vbg \quad (8)$$

In the case of FIG. 12 where the Vr-detecting charging bias Vg' is set to the lower limit $Vg_{MIN}$, if the background potential Vbg is set to the upper limit $Vbg_{MAX}$ (Yes at Step S31), the background potential Vbg of the upper limit $Vbg_{MAX}$ is used as it is without correcting the background potential Vbg (Step S32).

If the background potential Vbg is set to the lower limit $Vbg_{MIN}$ (Yes at Step S33), the background potential Vbg is corrected to a background potential Vbg3 using Equation (9) (Step S34):

$$Vbg=Vbg3=Vbg_{MIN}-(Vd'\text{ [calculated value]}-Vg_{MIN})\times\beta 2 \quad (9)$$

where β2 is a coefficient that is used in the same manner as in the β1 to maintain the ratio of the background potential to the development potential unchanged when the charging bias is an available value. The coefficient β2 is generally set equal to the background-potential coefficient α.

If the background potential Vbg is set between the upper limit $Vbg_{MAX}$ and the lower limit $Vbg_{MIN}$ (No at Step S33), the background potential Vbg is corrected to a background potential Vbg4 using Equation (10) (Step S35):

$$Vbg=Vbg4=Vbg-(Vd'\text{ [calculated value]}-Vg_{MIN})\times\beta 2 \quad (10)$$

If the background potential Vbg is equal to or larger than the upper limit $Vbg_{MAX}$ (Yes at Step S36), the background potential Vbg is set to the upper limit $Vbg_{MAX}$ (Step S37). After that, the Vr-detecting developing bias Vb' is corrected to a value calculated using Equation (11) (Step S38):

$$Vb'=Vg_{MIN}-Vbg_{MAX} \quad (11)$$

If the background potential Vbg is between the upper limit $Vbg_{MAX}$ and the lower limit $Vbg_{MIN}$ (No at Step S36), the Vr-detecting developing bias Vb' is corrected to a value calculated using Equation (12) (Step S39):

$$Vb' = Vg_{MIN} - Vbg \quad (12)$$

In the case of FIG. 13 where the Vr-detecting charging bias Vg' is set between the upper limit $Vg_{MAX}$ and the lower limit $Vg_{MIN}$, if the background potential Vbg is set to the upper limit $Vbg_{MAX}$ (Yes at Step S41), the background potential Vbg is corrected to a background potential Vbg5 using Equation (13) (Step S42):

$$Vbg = Vbg5 = Vbg_{MAX} - (Vd' \text{ [calculated value]} - Vd' \text{ [detected value]}) \quad (13)$$

If the background potential Vbg is set to the lower limit $Vbg_{MIN}$ (Yes at Step S43), the background potential Vbg is corrected to a background potential Vbg6 using Equation (14) (Step S44):

$$Vbg = Vbg6 = Vbg_{MIN} - (Vd' \text{ [calculated value]} - Vd' \text{ [detected value]}) \quad (14)$$

If the background potential Vbg is set between the upper limit $Vbg_{MAX}$ and the lower limit $Vbg_{MIN}$ (No at Step S43), the background potential Vbg is corrected to a background potential Vbg7 using Equation (15) (Step S45):

$$Vbg = Vbg7 = Vbg - (Vd' \text{ [calculated value]} - Vd' \text{ [detected value]}) \quad (15)$$

After that, the Vr-detecting developing bias Vb' is set to a value calculated using Equation (16) (Step S46):

$$Vb' = Vd' \text{ [detected value]} - Vbg \quad (16)$$

Referring back to FIG. 6, the surface of the photosensitive element 202 is exposed under the conditions of the Vr-detecting charging bias Vg' and the Vr-detecting developing bias Vb' in the similar manner as in Step S6, i.e., under the conditions of the exposure power LDP' and the exposure duty 15. The exposure power LDP' is 1.5 times (150%) stronger than the reference exposure power LDP0. The exposure duty 15 is the maximum exposure duty. After that, a potential of an electrostatic latent image (exposed area) that is formed under the above conditions is detected as the final residual exposed-area potential Vr by the potential sensor 210 (Step S11).

After detection of the target residual exposed-area potential Vr, an adjustment exposed-area potential Vpl is calculated using Equation (17) and the Vr-detecting target potential Vd' and the residual exposed-area potential Vr (Step S12):

$$Vpl = (Vd' - Vr)/3 + Vr \quad (17)$$

The adjustment exposed-area potential Vpl is in a low exposure-amount ranging from the left side to around the center of each of the graphs in FIGS. 14A and 14B. That is, the adjustment exposed-area potential Vpl changes largely as the exposure amount changes.

A provisional charging bias Vg" and a provisional developing bias Vg" are calculated and set using the residual exposed-area potential Vr in the similar manner as the processes of Steps S7 to S10 (Step S13).

An exposure power for obtaining the adjustment exposed-area potential Vpl (hereinafter, "Vpl-obtaining exposure power" or "provisional reference exposure amount") is then identified (Step S14). The adjustment exposed-area potential Vpl is about ⅓ of the reference exposed-area potential in the embodiment. Therefore, the exposure duty 5/15, which is ⅓ of the reference exposure amount (exposure duty=15/15), is used to calculate the suitable Vpl-obtaining exposure power.

To identify the Vpl-obtaining exposure power, electrostatic latent images are formed with the fixed exposure duty 5/15 and different exposure powers including an exposure power 60% of the reference exposure power LDP0, an exposure power 80%, an exposure power 100%, an exposure power 120%, and an exposure power 150% under the conditions of the provisional charging bias Vg" and the provisional developing bias Vb" that are set at Step S13. The potential sensor 210 then detects the exposed-area potential of each electrostatic latent image and the charging potential Vd. After that, the adjustment exposed-area potentials Vpl are calculated using Equation (17) and the exposure powers, the charging potentials Vd, and the residual exposed-area potentials Vr. As a result, five data sets indicative of the relation between the adjustment exposed-area potential Vpl and the exposure power are obtained. A linear approximate equation is then calculated using the data sets based on a first-order approximation and a least-square approach. The Vpl-obtaining exposure power for obtaining the adjustment exposed-area potential Vpl that is calculated at Step S12 is identified using the linear approximate equation.

After that, the surface of the photosensitive element 202 is exposed to the identified Vpl-obtaining exposure power (exposure duty 5/15). The exposed-area potential is then detected by the potential sensor 210. If the exposed-area potential is within a target range around the adjustment exposed-area potential Vpl that is calculated at Step S12 (within a range from Vpl-3 V to Vpl+3 V), the identified Vpl-obtaining exposure power is used. However, if the exposed-area potential is out of the target range, the identified Vpl-obtaining exposure power is adjusted using a predetermined adjustment value. After that, the surface of the photosensitive element 202 is exposed to the adjusted Vpl-obtaining exposure power. The exposed-area potential is then detected by the potential sensor 210. The same process is repeated until the exposed-area potential within the target range is detected.

After the Vpl-obtaining exposure power is identified, the Vpl-obtaining exposure power is converted to the exposure power of the exposure duty 15/15 that is equivalent to the exposure duty of the reference exposure amount (Step S15). Because the exposure duty that is used to identify the Vpl-obtaining exposure power is ⅓ of the exposure duty 15/15 of the reference exposure amount in the embodiment, the Vpl-obtaining exposure power identified at Step S14 is multiplied by three. In this manner, the identified Vpl-obtaining exposure power is converted to the exposure power of the exposure duty 15/15.

The reference exposure power is determined from the converted exposure power (Step S16). It has been known according to experiments or the like that the reference exposure power is about ⅔ of the converted exposure power. Therefore, in the embodiment, a value that is obtained by multiplying the converted exposure power by ⅔ is set to the reference exposure power. The conversion value (⅔ in the embodiment) can be set appropriately according to experiments or the like.

After the reference exposure power is calculated in this manner, the reference exposed-area potential VL0', which is the provisional value calculated at Step S7, is corrected to the actual reference exposed-area potential VL0. More particularly, an electrostatic latent image (exposed area) is formed using the reference exposure amount (the reference exposure power that is set at Step S16 and the exposure duty 15/15) under the conditions of the provisional charging bias Vg" and the provisional developing bias Vb" that are set at Step S13. The potential of the exposed area (the reference exposed-area potential VL0) is then detected by the potential sensor 210

(Step S17). A difference ΔVL between the detected reference exposed-area potential VL0 and the reference exposed-area potential VL0' that is the provisional value set at Step S7 is calculated (Step S18). The provisional charging bias Vg" and the provisional developing bias Vb" that are set at Step S13 are corrected using the difference ΔVL to the final charging bias Vg and the final developing bias Vb (Step S19). More particularly, the final charging bias Vg is calculated using Equation (18) and the final developing bias Vb is calculated using Equation (19):

$$Vg=Vg''-\Delta VL \tag{18}$$

$$Vb=Vb''-\neq 6VL \tag{19}$$

However, if the corrected charging bias Vg is smaller than its lower limit or larger than its upper limit, the charging bias Vg before correction is used as the final value. If the corrected developing bias Vb is smaller than its lower limit or larger than its upper limit, the developing bias Vb before correction is used as the final value.

In the embodiment, both the development potential and the background potential are adjusted in such a manner that the charging bias Vg cannot exceed the upper limit $Vg_{MAX}$. More particularly, the ratio of the development potential to the background potential is set to the background-potential coefficient α. This adjustment makes it possible to suppress the image degradation due to the change of the width of the line and the halftone density, while setting the charging bias Vg lower than the upper limit $Vg_{MAX}$. However, because the development potential is set slightly low in this adjustment, the image density decreases slightly. This may cause a slight change in the image quality. If the image density must be remained high, it is allowable to adjust only the background potential for an excess of the charging bias Vg over the upper limit $Vg_{MAX}$. In the latter case, although a slight change of the ratio of the development potential to the background potential may cause a slight image quality change due to a change of the width of the line and the halftone density, the image density is remained high.

The printer according to the embodiment includes the photosensitive element 202 in which the ratio of the decrease in the exposed-area potential to the increase in the exposure amount decreases as the exposure amount increases; the charging unit 201 that evenly charges the surface of the photosensitive element 202 so that the potential of the surface of the photosensitive element 202 becomes the target potential Vd; the writing unit 203 that exposes the surface of the photosensitive element 202 that is charged by the charging unit 201 to an exposure amount by referring to the reference exposure amount that is within a high exposure-amount area where the ratio of the decrease in the exposed-area potential to the increase in the exposure amount is smaller than a threshold, thereby forming an electrostatic latent image on the surface of the photosensitive element 202 where the exposure to light decreases a potential of an exposed area; and the developing unit 205 that develops the electrostatic latent image into a toner image by applying toner to the electrostatic latent image using the developer carrier (the development roller) that is charged with a development bias. The printer transfers the toner image that is formed on the surface of the photosensitive element 202 to the recording sheet 112, thus forming the image on the recording sheet 112. The printer further includes the control unit 41 that determines the reference exposure amount that is used when the writing unit 203 performs image formation and the potential sensor 210 that detects the potential of the surface of the photosensitive element 202. In the process control for adjusting the exposure amount, under control of the control unit 41, the charging unit 201 charges the surface of the photosensitive element 202; the writing unit 203 exposes the charged surface of the photosensitive element 202 to a high exposure amount (using the exposure power of 1.5 time stronger than the reference exposure power and the exposure duty 15/15) for adjustment; the potential sensor 210 detects the potential of the exposed area that is exposed to the high exposure amount as the residual exposed-area potential Vr. After that, the control unit 41 determines the reference exposure amount based on the target potential Vd' and the residual exposed-area potential Vr. Because the reference exposure duty is fixed to 15/15 in the embodiment, the control unit 41 determines, more particularly, the reference exposure power. The printer acquires, using the residual exposed-area potential Vr, the relation between the exposure amount and the exposed-area potential under the present conditions. The printer then identifies an appropriate exposed-area potential (target exposed-area potential) to be obtained when the surface of the photosensitive element 202 is exposed to the reference exposure amount and determines the reference exposure amount corresponding to the target exposed-area potential. Thus, the reference exposure amount suitable for the present conditions is determined. Because it is not necessary to store in the printer the various data tables for expected changes due to the passage of time and changes in the environment, the suitable reference exposure amount is determined without an increase of the amount of required data.

In particularly, the control unit 41 determines the reference exposure in the following manner. The control unit 41 calculates using the target potential Vd' and the residual exposed-area potential Vr the adjustment exposed-area potential Vpl that is within a low exposure-amount area where the ratio of the decrease in the exposed-area potential to the increase of the exposure amount is larger than the threshold. The control unit 41 calculates the provisional reference exposure amount in such a manner that the exposed-area potential on the surface of the photosensitive element 202 becomes the calculated adjustment exposed-area potential Vpl. The control unit 41 then converts the provisional reference exposure amount to the reference exposure amount using the conversion relation. Thus, the reference exposure amount that is used when the writing unit 203 performs image formation is determined. With this configuration, because the exposure amount is adjusted within an area where the ratio of the decrease in the exposed-area potential to the increase in the exposure amount is large, an error of measurement by the potential sensor 210, if any, scarcely affects the adjustment.

Moreover, because Equation (17) Vpl=(Vd'−Vr)/3+Vr is used to calculate the adjustment exposed-area potential Vpl, the adjustment exposed-area potential Vpl that is within the low exposure-amount area can be calculated easily.

Furthermore, the provisional reference exposure amount is calculated using the adjustment exposed-area potential Vpl in the following manner. The surface of the photosensitive element 202 that is charged by the charging unit 201 is exposed to various low exposure amounts that are within the low exposure-amount area under conditions of various exposure powers (60%, 80%, 100%, 120%, and 150% of the reference exposure power) and the fixed unit exposure time, i.e., the fixed exposure duty 5/15 that is shorter than the unit exposure time 15/15 that is used for the adjustment. The unit exposure time is the exposure time per a 1-dot electrostatic latent image. The potential sensor 210 then detects the potentials of the exposed areas. After that, the exposure power (converted exposure power) is calculated using the various low exposure amount and the results detected by the potential sensor 210 corresponding to the various low exposure amounts in such a manner that the exposed-area potential that is detected when the surface of the photosensitive element 202 is exposed to the short exposure time 5/15 becomes the adjustment exposed-area potential Vpl. The provisional reference exposure amount is then calculated using the calculated converted exposure power and the short exposure time 5/15. The conventional image forming apparatus, in contrast, acquires the relation between the adjustment exposed-area potential Vpl and the provisional reference exposure amount using the experiments or the like, stores the data tables representing the relation, and identifies the provisional reference exposure amount by referring to the data tables. Because the printer according to the embodiment does not use the data tables, an increase in the amount of required data is suppressed.

Moreover, the exposure duty of the reference exposure amount is set to 15/15 equal to the exposure duty that is used for the adjustment. The control unit 41 multiplies the exposure power of the provisional reference exposure amount by the ratio of the exposure duty 15/15 that is used for the adjustment to the short exposure time, i.e., exposure duty 5/15, thereby obtaining the exposure power corresponding to the provisional reference exposure amount and based on the exposure duty the same used in the adjustment. The control unit 41 then converts the calculated exposure power using the predetermined conversion equation to a value smaller than the exposure power before conversion and larger than the exposure power of the provisional reference exposure power and determines the converted exposure power to be the exposure power of the reference exposure amount. Thus, the exposure power of the reference exposure amount is determined appropriately in an easy manner.

Furthermore, when the surface of the photosensitive element 202 is exposed to the various low exposure amounts, the control unit 41 uses the provisional target potential Vd' that is obtained by adding the provisional exposed-area potential VL0', which is calculated by adding the correction value (−50 V) to the residual exposed-area potential Vr, and the development potential VbL. That is, the provisional target potential Vd' is not a fixed value but a variable value depending on the residual exposed-area potential Vr. With the usage of the variable target potential Vd', the printer can perform adjustment, taking the current photosensitivity of the photosensitive element 202 into consideration.

Moreover, after the reference exposure amount is determined, the charging unit 201 charges the surface of the photosensitive element 202 so that the surface becomes the provisional target potential Vd'. The writing unit 203 exposes the charged surface of the photosensitive element 202 to the reference exposure amount. The potential sensor 210 detects the potential of the exposed area as the reference exposed-area potential VL0. After that, the provisional target potential Vd' is corrected using the difference ΔVL between the detected reference exposed-area potential VL0 and the provisional reference exposed-area potential VL0', and the corrected value is determined to be the target potential Vd that is used when the charging unit 201 performs image formation. In this manner, the appropriate target potential Vd is determined.

According to an aspect of the present invention, in an adjustment of an amount of exposure, an appropriate reference exposure amount is determined by a detected charging potential or a target potential and a detected residual potential. By employing this method, even if a specific photosensitive element is used in which a relation between the amount of exposure that is used for image formation and an exposed-area potential VL changes significantly with passage of time or because of changes in the environment, an appropriate reference exposure amount can be determined without data tables for expected changes due to the passage of time and changes in the environment.

Therefore, an appropriate reference exposure amount can be determined without an increase in an amount of required data.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a recording medium, the image forming apparatus comprising:

a photosensitive element having a photoconductive property in which a ratio of a decrease in an exposed-area potential to an increase in an exposure amount decreases as the exposure amount increases;

a charging unit that charges a surface of the photosensitive element evenly to a target potential;

an exposure unit that exposes an exposure target area on charged surface of the photosensitive element to light of an exposure amount thereby forming an electrostatic latent image in the exposure target area by lowering a potential of the exposure target area, the exposure amount being determined based on a reference exposure amount that corresponds to a high-exposure amount area for which a ratio of a decrease in a potential of an exposure area on the photosensitive element to an increase in an exposure amount is smaller than a threshold;

a developing unit that develops the electrostatic latent image on the photosensitive element into a toner image by applying toner to the electrostatic latent image using a developer carrier that is charged with a development bias;

a transferring unit that transfers the toner image from the photosensitive element onto a recording medium;

a control unit that determines the reference exposure amount that is used when the exposure unit performs image formation; and a potential detecting unit that detects a potential of the surface of the photosensitive element, wherein when performing adjustment of exposure amount, the control unit causes the charging unit to charge the surface of the photosensitive element and, after the exposure target area on the charged surface of the photosensitive element is exposed to a high adjustment exposure that corresponds to the high-exposure amount area, determines the reference exposure amount based on either a detected charging potential that is detected by the potential detecting unit as a potential of the charged surface, or the target potential and a detected residual potential that is detected by the potential detecting unit as a potential of the target exposure area on the photosensitive element after being exposed to the high adjustment exposure.

2. The image forming apparatus according to claim 1, wherein the control unit calculates, using either the detected charging potential or the target potential and the detected residual potential, an adjustment exposed-area potential that corresponds to a low-exposure amount area for which a ration of a decrease in a potential of the exposure area on the photosensitive element to an increase in an exposure amount is larger than the threshold, calculates a provisional reference exposure amount with which when the exposure area on the photosensitive element is exposed causes a potential of the exposure area to be changed to the adjustment exposed-area potential, and converts the provisional reference exposure amount to the reference exposure amount based on a predetermined relation thereby obtaining the reference exposure amount.

3. The image forming apparatus according to claim 2, wherein the control unit calculates the adjustment exposed-area potential Vpl by using $$Vpl=(Vd-Vr)/a+Vr$$

where Vd is the detected charging potential or the target potential, Vr is the detected residual potential, and a is a constant that is predetermined so that a result corresponding to the low-exposure amount area can be obtained in calculation for the adjustment exposed-area potential Vpl.

4. The image forming apparatus according to claim 2, wherein, to calculate the provisional reference exposure amount using the adjustment exposed-area potential, after the exposure unit exposes the exposure target area on the charged photosensitive element to a plurality of different low exposure amounts that are obtained by changing an exposure power with a unit exposure time, which is an exposure time per 1-dot electrostatic latent image, being fixed to a first unit exposure time that is shorter than a second unit exposure time corresponding to the high adjustment exposure so that all the low exposure amounts correspond to the low-exposure amount area, the potential detecting unit detects a potential of the target exposure area, and the control unit calculates, using the low exposure amounts and the potential detected by the potential detecting unit corresponding to the low exposure amounts, a first exposure power so that if the target exposure area is exposed to an exposure amount defined by the first exposure power and the first unit exposure time, a potential of the target exposure area is the adjustment exposed-area potential, and calculates the provisional reference exposure amount using the first exposure power and the first unit exposure time.

5. The image forming apparatus according to claim 4, wherein a third unit exposure time of the reference exposure amount is set equal to the second unit exposure time, and the control unit calculates a second exposure power, from which the provisional reference exposure amount is calculated if the unit exposure time is equal to the second unit exposure time of the high adjustment exposure, by multiplying the first exposure power of the provisional reference exposure amount by a ratio of the second unit exposure time to the first unit exposure time, converts the second exposure power into a third exposure power that is smaller than the second exposure power and larger than the first exposure power using a predetermined conversion equation, and determines the third exposure power to be an exposure power of the reference exposure amount.

6. The image forming apparatus according to claim 4, wherein, when the surface of the photosensitive element is to be exposed to the low exposure amounts, the control unit uses a provisional target potential that is obtained by adding a development potential to a provisional exposed-area potential that is obtained by adding a correction value to the detected residual potential as the target potential to which the charging unit charges the surface of the photosensitive element.

7. The image forming apparatus according to claim 6, wherein, after determining the reference exposure amount, the control unit causes the charging unit to charge the surface of the photosensitive element to the provisional target potential, corrects the provisional target potential using a difference between the potential detected by the potential detecting unit as a potential of the target exposure area on the charged photosensitive element that is exposed to the reference exposure amount by the exposing unit and the provisional exposed-area potential, and determines corrected provisional target potential to be the target potential.

* * * * *